US011497366B2

(12) United States Patent
Xu et al.

(10) Patent No.: US 11,497,366 B2
(45) Date of Patent: Nov. 15, 2022

(54) CYCLONIC SEPARATOR FOR A VACUUM CLEANER AND A VACUUM CLEANER HAVING THE SAME

(71) Applicant: SharkNinja Operating, LLC, Needham, MA (US)

(72) Inventors: Kai Xu, Suzhou (CN); Andre D. Brown, Natick, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/751,545

(22) Filed: Jan. 24, 2020

(65) Prior Publication Data

US 2020/0237171 A1 Jul. 30, 2020

Related U.S. Application Data

(60) Provisional application No. 62/821,357, filed on Mar. 20, 2019, provisional application No. 62/796,654, filed on Jan. 25, 2019.

(51) Int. Cl.
*A47L 9/16* (2006.01)

(52) U.S. Cl.
CPC ..... *A47L 9/1641* (2013.01); *A47L 9/1608* (2013.01); *A47L 9/1625* (2013.01); *A47L 9/1683* (2013.01)

(58) Field of Classification Search
CPC .... A47L 9/1641; A47L 9/1608; A47L 9/1625; A47L 9/1683; B04C 3/06; B04C 2003/003; B04C 5/08–0811; B04C 5/13; B04C 5/187; B01D 19/0057; F16K 24/04; F22B 37/265
USPC ..... 15/353; 55/343–346
See application file for complete search history.

(56) References Cited

U.S. PATENT DOCUMENTS 3,633,344 A * 1/1972 Blank ..... F22B 37/32 55/459.3
3,947,364 A * 3/1976 Laval, Jr. ..... B04C 5/04 210/512.1
4,205,965 A * 6/1980 Bielefeldt ..... B04C 7/00 95/271
4,265,640 A * 5/1981 Bielefeldt ..... B01D 45/12 95/271

(Continued)

FOREIGN PATENT DOCUMENTS

AU 2009303161 A1 * 3/2011 ..... A47L 9/108
CN 102497799 6/2012

(Continued)

OTHER PUBLICATIONS

PCT Search Report and Written Opinion dated Jun. 26, 2020, received in PCT Application No. PCT/US20/14916, 13 pgs.

(Continued)

*Primary Examiner* — Joseph J Hail
*Assistant Examiner* — Jonathan R Zaworski
(74) *Attorney, Agent, or Firm* — Grossman Tucker Perreault & Pfleger, PLLC

(57) ABSTRACT

A vacuum cleaner may include a suction motor and a cyclonic separator fluidly coupled to the suction motor. The cyclonic separator may include a chamber and a first and a second vortex finder extending within the chamber. The first and second vortex finders may extend from opposing sides of the chamber.

19 Claims, 17 Drawing Sheets

(56) References Cited

U.S. PATENT DOCUMENTS 4,801,310 A * 1/1989 Bielefeldt ..... B04C 3/06 95/271
4,895,582 A * 1/1990 Bielefeldt ..... B01D 21/0087 55/413
4,908,049 A * 3/1990 Yoshida ..... B04C 5/081 209/11
4,956,091 A * 9/1990 Van Den Akker ..... B01D 45/12 209/710
4,961,863 A * 10/1990 Van Den Akker ..... B01J 8/005 210/788
5,843,211 A * 12/1998 Bielefeldt ..... B01D 45/12 95/271
6,572,668 B1 * 6/2003 An ..... A47L 9/1641 55/459.1
6,679,930 B1 * 1/2004 An ..... B04C 7/00 55/459.1
7,497,886 B2 * 3/2009 Walker ..... B04C 5/187 451/453
7,717,973 B2 * 5/2010 Oh ..... A47L 9/1683 15/352
7,749,296 B2 7/2010 Han et al.
7,951,216 B2 * 5/2011 Ha ..... A47L 9/1658 15/352
8,186,006 B2 * 5/2012 Hyun ..... A47L 9/1625 15/347
8,316,507 B2 * 11/2012 Hyun ..... A47L 9/165 15/353
8,484,799 B2 * 7/2013 Conrad ..... B01D 45/12 15/353
8,528,163 B2 * 9/2013 Park ..... A47L 9/26 15/352
8,584,313 B2 * 11/2013 Kim ..... A47L 9/1691 15/347
8,591,615 B2 * 11/2013 Kim ..... B01D 46/681 15/352
8,713,752 B2 * 5/2014 Kang ..... A47L 9/108 15/348
8,728,188 B2 * 5/2014 Kim ..... A47L 5/362 55/429
8,881,343 B2 11/2014 Park et al.
8,887,349 B2 * 11/2014 Lee ..... A47L 9/122 15/327.1
8,978,197 B2 * 3/2015 Kang ..... A47L 9/108 15/347
9,107,551 B2 * 8/2015 Kwon ..... A47L 9/0045
9,504,365 B2 * 11/2016 Kim ..... A47L 9/12
9,801,515 B2 * 10/2017 Kim ..... A47L 9/1683
10,512,863 B2 * 12/2019 Magnus ..... B01D 45/08
10,668,485 B2 * 6/2020 Kraxner ..... B01D 45/16
10,780,380 B1 * 9/2020 Rhodes ..... B01D 45/12
2005/0015920 A1 1/2005 Kim et al.
2009/0056290 A1 * 3/2009 Oh ..... A47L 9/1683 55/337
2009/0293224 A1 * 12/2009 Hyun ..... A47L 9/1666 15/353
2009/0305862 A1 12/2009 Yoo
2010/0115727 A1 * 5/2010 Oh ..... A47L 9/1625 96/416
2010/0192776 A1 * 8/2010 Oh ..... B04C 5/185 55/393
2010/0263161 A1 * 10/2010 Lee ..... A47L 9/108 15/347
2010/0319307 A1 * 12/2010 Kim ..... B01D 46/521 55/301
2013/0091661 A1 4/2013 Smith
2013/0160233 A1 6/2013 Peace et al.
2016/0150934 A1 6/2016 Kim et al.
2017/0319033 A1 11/2017 Hyun et al.
2018/0055317 A1 3/2018 Hyun et al.
2019/0076770 A1 * 3/2019 Denton ..... E21B 43/34
2020/0046190 A1 2/2020 Conrad

FOREIGN PATENT DOCUMENTS

CN 213155661 U * 5/2021
DE 3735106 A1 * 4/1989 ..... B04C 9/00
EP 1859719 A2 * 11/2007 ..... A47L 5/365
EP 3000372 3/2016
GB 2374033 A * 10/2002 ..... A47L 9/1633
JP H07265236 A * 10/1995
JP 2014000561 A * 1/2014
JP 2016107094 6/2016
KR 20090131463 A * 6/2008
WO 2008114966 9/2008
WO 2017024241 A1 2/2017

OTHER PUBLICATIONS

"Pupppyoo Powerful Portable Rechargeable 2-in-1 Cordless Stick Vacuum Cleaner A9", www.amazon.co.uk, Jan. 19, 2019, 4 pgs.
Chinese Office Action with English translation dated Feb. 9, 2022, received in Chinese Patent Application No. 202080010791.X, 8 pages.
Australian Patent Application dated Aug. 24, 2022, received in Australian Patent Application No. 2020210766, 4 pages.
Japanese Patent Application with Machine English Translation, dated Aug. 30, 2022, received in Japanese Patent Application No. 2021-543193, 10 pages.
Extended European Search Report dated Sep. 21, 2022, received in European Patent Application No. 20744592.5, 8 pages.

* cited by examiner

| ORIFICE DIAMETER INCHES | AIR POWER | AIR FLOW (CFM) | CORRECTED SUCTION H (IN H2O) |
|---|---|---|---|
| 2.000 | 1.59 | 27.79 | 0.4 |
| 1.500 | 5.16 | 27.62 | 1.2 |
| 1.250 | 10.30 | 28.01 | 1.29 |
| 1.000 | 23.15 | 28.06 | 5.93 |
| 0.875 | 35.01 | 26.45 | 9.54 |
| 0.750 | 54.17 | 25.27 | 15.74 |
| 0.625 | 78.20 | 22.87 | 25.81 |
| 0.500 | 99.13 | 18.88 | 41.15 |
| 0.375 | 98.61 | 13.43 | 59.77 |
| 0.250 | 60.59 | 6.90 | 72.25 |
| 102.57 AIR WATTS | | | |
| OUTPUT EFFICIENCY: 34.19% | | | |

FIG. 16

| MOTOR SET POWER W | TOTAL EFFICIENCY -% | SINGLE CYCLONE EFFICIENCY -% |
|---|---|---|
| 300 | 98.69 | 98.38 |

FIG. 17

CYCLONIC SEPARATOR FOR A VACUUM CLEANER AND A VACUUM CLEANER HAVING THE SAME

CROSS-REFERENCE TO RELATED APPLICATIONS

The present application claims the benefit of U.S. Provisional Application Ser. No. 62/796,654 filed on Jan. 25, 2019, entitled Cyclonic Separator for a Vacuum Cleaner and a Vacuum Cleaner having the same and U.S. Provisional Application Ser. No. 62/821,357 filed on Mar. 20, 2019, entitled Cyclonic Separator for a Vacuum Cleaner and a Vacuum Cleaner having the same, each of which are fully incorporated herein by reference.

TECHNICAL FIELD

The present disclosure is generally related to surface treatment apparatuses and more specifically related to a cyclonic separator for a vacuum cleaner.

BACKGROUND INFORMATION

Surface treatment apparatuses can include vacuum cleaners configured to be transitionable between a storage position and an in-use position. Vacuum cleaners can include a suction motor configured to draw air into an air inlet of the vacuum cleaner such that debris deposited on a surface can be urged into the air inlet. At least a portion of the debris urged into the air inlet can be deposited within a dust cup of the vacuum cleaner for later disposal.

BRIEF DESCRIPTION OF THE DRAWINGS

These and other features and advantages will be better understood by reading the following detailed description, taken together with the drawings, wherein:

FIG. 16 is a table showing an example of air power, air flow, and suction for various orifice (e.g., inlet to the suction motor) diameters of an example of the vacuum cleaner of FIG. 3, consistent with embodiments of the present disclosure.

FIG. 17 is a table showing the efficiency of an example of the cyclonic separator of an example of the vacuum cleaner of FIG. 3, consistent with embodiments of the present disclosure.

DETAILED DESCRIPTION

The present disclosure is generally related to a cyclonic separator for use with a vacuum cleaner. An example of the cyclonic separator includes a chamber configured to be fluidly coupled to a suction motor of the vacuum cleaner. A first and a second vortex finder extend within the chamber. The first and second vortex finders extend from opposing sides of the chamber. The first and second vortex finders can each define a respective fluid pathway through which air can flow and can be configured to operate in series (e.g., air flows cyclonically around a first vortex finder before extending cyclonically around a second vortex finder) or in parallel (e.g., air flows cyclonically around either of a first or a second vortex finder).

Distal ends of the first and second vortex finders can be spaced apart from each other within the chamber by a separation distance. The separation distance may reduce and/or prevent the wrapping of fibrous debris (e.g., hair) around the vortex finders. As such, the chamber may not include an arrestor plate that extends between the vortex finders. Omission of the arrestor plate may improve the performance of the vacuum cleaner (e.g., by reducing the occurrence of blockages within the chamber). In some instances, the chamber may have the shape of a truncated sphere having opposing planar surfaces from which the first and second vortex finders respectively extend. Such a configuration may improve separation efficiency of debris from air flowing therethrough, which may reduce the frequency with which filters within the vacuum cleaner are cleaned and allow for more consistent performance of the vacuum cleaner over a longer period of time.

Figure 1:
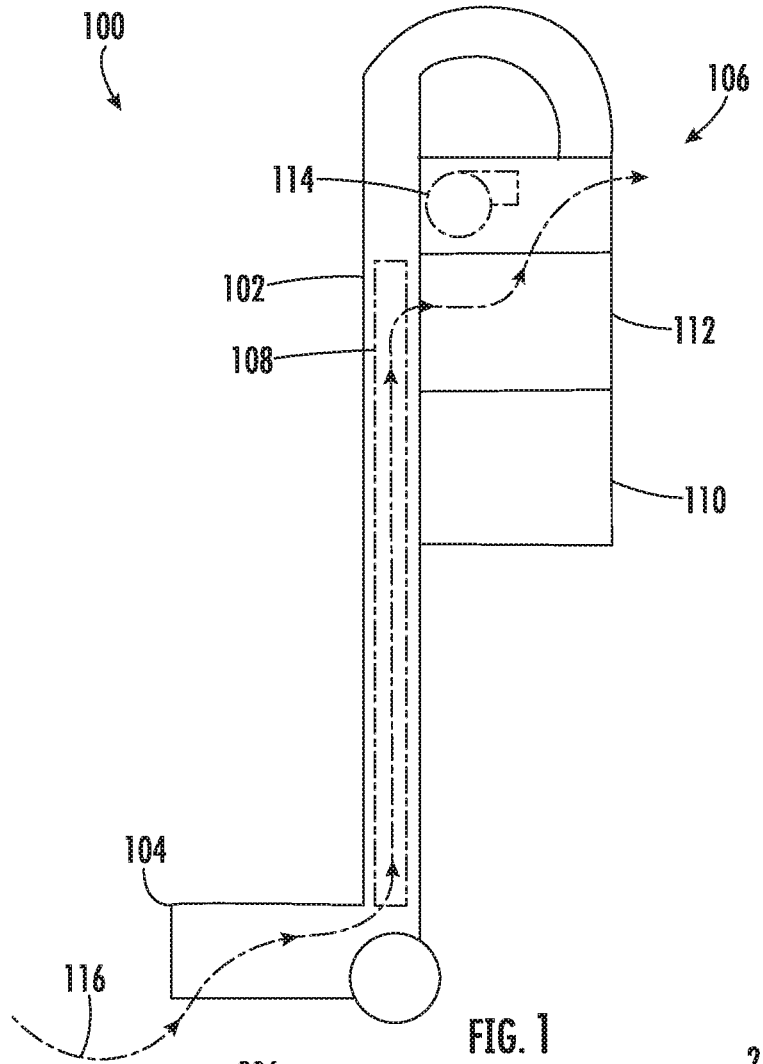
FIG. 1 is a schematic example of a vacuum cleaner, consistent with embodiments of the present disclosure.

FIG. 1 shows a schematic example of a vacuum cleaner 100. The vacuum cleaner 100 includes a wand 102, a cleaning accessory 104 (e.g., a surface cleaning head having one or more brush rolls), and a vacuum assembly 106. At least a portion of the wand 102 defines an air channel 108 (shown in hidden lines) that fluidly couples the cleaning accessory 104 to the vacuum assembly 106. At least a portion of the vacuum assembly 106 is coupled to the wand 102 and includes a dust cup 110, a cyclonic separator 112, and a suction motor 114 (shown in hidden lines). The suction motor 114 may include, for example, a brushless direct current (DC) motor or a brushed DC motor (e.g., a carbon brush DC motor). The cyclonic separator 112 is fluidly coupled to the air channel 108 at a first location along the wand 102 and the cleaning accessory 104 is fluidly coupled to the air channel 108 at a second location along the wand 102. In some instances, the vacuum cleaner 100 may be used without the cleaning accessory 104 (e.g., only the wand 102 is used to clean a surface).

The suction motor 114 is configured to draw air along an air path 116 such that air flows into the cyclonic separator 112 through the suction motor 114 and is exhausted from the vacuum assembly 106. In other words, the suction motor 114 may generally be described as being fluidly coupled to the cyclonic separator 112. As air flows through the cyclonic separator 112, at least a portion of any debris entrained within the airflow is separated by cyclonic action from the airflow and deposited in the dust cup 110. In some instances, after passing through the cyclonic separator 112 and before passing through the suction motor 114, the air may pass through a premotor filter. In some instances, before being exhausted from the vacuum assembly 106 and after passing through the suction motor 114, the air may pass through a post motor filter. The post motor filter may be high-efficiency particulate air (HEPA) filter.

While the vacuum cleaner 100 is generally shown as an upright vacuum cleaner, the vacuum cleaner 100 may be any type of vacuum cleaner. For example, the vacuum cleaner 100 may be a handheld vacuum cleaner, a cannister vacuum cleaner, a robotic vacuum cleaner, and/or any other type of vacuum cleaner.

Figure 2:
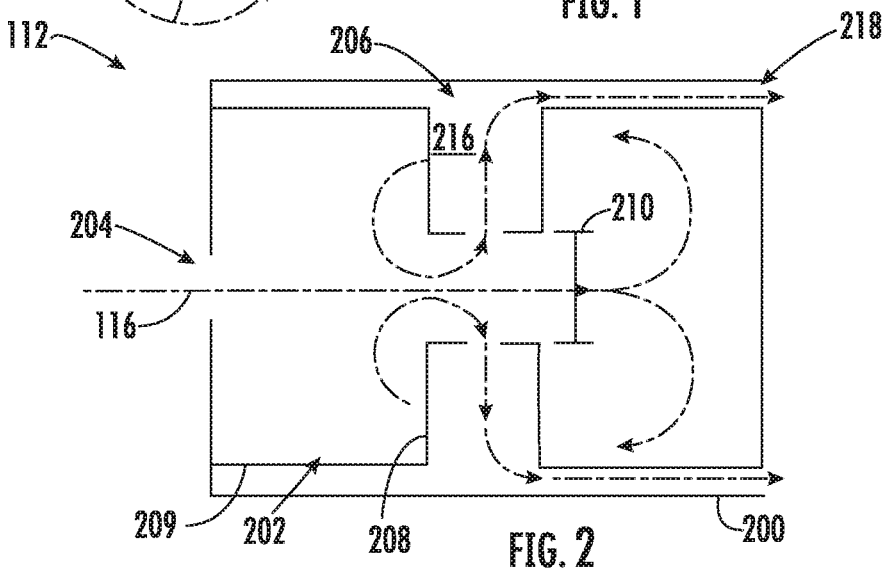
FIG. 2 is a schematic cross-sectional side view of a cyclonic separator, consistent with embodiments of the present disclosure.

FIG. 2 shows a schematic cross-sectional side view of an example of the cyclonic separator 112 of FIG. 1, wherein the example cyclonic separator includes two vortex finders operating in parallel. As shown, the cyclonic separator 112 includes a housing 200 and a cyclone chamber 202. The housing 200 extends around at least a portion of the cyclone chamber 202 and may define at least a portion of the cyclone chamber 202. Additionally, or alternatively, the cyclone chamber 202 may be defined, at least in part, by one or more chamber sidewalls 209. The cyclone chamber 202 includes one or more air inlets 204 and a plurality of air outlets 206. The one or more air inlets 204 are fluidly coupled to the air channel 108 defined within the wand 102. Each air outlet 206 is fluidly coupled to a respective vortex finder 208. Each vortex finder 208 can be configured to encourage the development of a cyclone therearound.

As shown, the vortex finders 208 extend into the cyclone chamber 202 from opposing sides of the cyclone chamber 202 in a direction towards each other. Distal ends of the vortex finders 208 are spaced apart from each other by a separation distance 210. The cyclone chamber 202 is configured such that at least a portion of air flowing within the cyclone chamber 202 along the air path 116 is urged into cyclonic motion about each of the vortex finders 208. For example, the air path 116 can enter the cyclone chamber 202 at a location spaced apart from a central axis of the vortex finders 208. As such, the air path 116 is urged towards the vortex finders 208, encouraging the cyclonic motion of air flowing along the air path 116.

As also shown, the vortex finders 208 define respective fluid pathways 216 therein, each being fluidly coupled to respective air outlets 206. The air outlets 206 are fluidly coupled to one or more ducts 218 defined between the housing 200 and the cyclone chamber 202. The ducts 218 are configured to fluidly couple the cyclone chamber 202 to, for example, the suction motor 114 of FIG. 1. In other words, the ducts 218 fluidly couple one or more vortex finders 208 to the suction motor 114 such that air drawn through the vortex finders 208 by the suction motor 114 passes through the ducts 218. As such, when the suction motor 114 generates suction, air is drawn through the ducts 218 and the vortex finders 208 before passing through the suction motor 114. The ducts 218 may be at least partially defined by sidewalls of the housing 200 and/or sidewalls of the cyclone chamber 202. Additionally, or alternatively, the ducts 218 may be at least partially defined by a separate conduit.

The vortex finders 208 may have a shape that encourages the development of a cyclone therearound. For example, the vortex finders 208 can have a cylindrical shape, a frustoconical shape, and/or any other shape or combination of shapes configured to encourage the development of a cyclone therearound.

Figure 3:
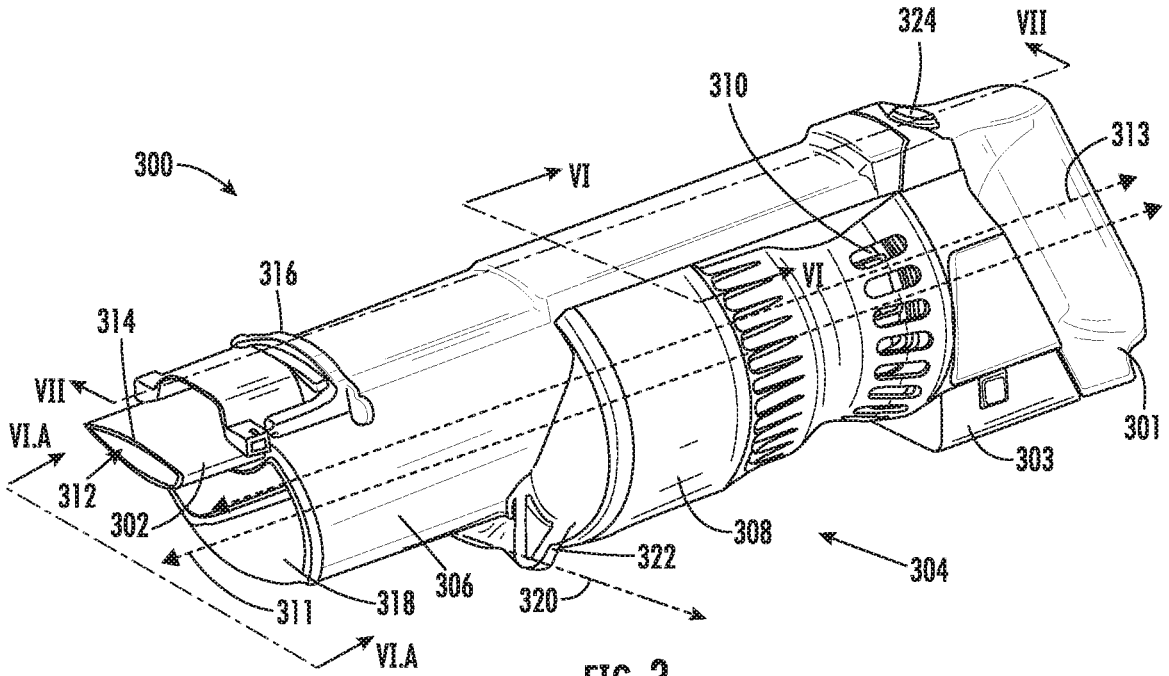
FIG. 3 is a perspective view of a vacuum cleaner, consistent with embodiments of the present disclosure.

FIG. 3 shows a perspective view of a vacuum cleaner 300, which may be an example of the vacuum cleaner 100 of FIG. 1. As shown, the vacuum cleaner 300 includes a handle 301, a wand 302, a power source 303 (e.g., one or more batteries), and a vacuum assembly 304 fluidly coupled to the wand 302. The handle 301 is coupled to one or more of at least a portion of the wand 302 and/or at least a portion of the vacuum assembly 304. The power source 303 may include, for example, one or more batteries. In some instances, the one or more batteries may have, for example, a number of cells in a range of 2 cells to 5 cells, an energy capacity in a range of 1,500 milliamp-hours (mAh) to 2,500 mAh, and a voltage output in a range of 9 volts to 12 volts. Additionally, or alternatively, the power source 303 may be configured to electrically couple the vacuum cleaner 300 to an electrical power grid via, for example, an electrical outlet.

The vacuum assembly 304 includes a dust cup 306, a cyclonic separator 308, and a suction motor 310. The dust cup 306, the cyclonic separator 308, and the suction motor 310 are aligned along a vacuum assembly longitudinal axis 311 (e.g., the dust cup 306, the cyclonic separator 308, and the suction motor 310 may be centrally aligned along the vacuum assembly longitudinal axis 311). The vacuum assembly longitudinal axis 311 extends parallel to a vacuum cleaner longitudinal axis 313 of the vacuum cleaner 300. The cyclonic separator 308 is disposed between the dust cup 306 and the suction motor 310. As shown, the suction motor 310 is disposed between the handle 301 and the cyclonic separator 308 and the power source 303 (e.g., one or more batteries) is disposed between the suction motor 310 and the handle 301. Such a configuration may reduce an amount of effort required to be exerted by a user to operate the vacuum cleaner 300 using one hand. However, other arrangements are possible. For example, the suction motor 310 can be offset from the dust cup 306 and the cyclonic separator 308. By way of further example, the dust cup 306 can be disposed between the suction motor 310 and the cyclonic separator 308.

The cyclonic separator 308 and the suction motor 310 are fluidly coupled to the wand 302. The wand 302 defines an air channel 312, which is fluidly coupled to the cyclonic separator 308 and the suction motor 310. The suction motor 310 is configured to cause air to be drawn into an air inlet 314 of the air channel 312. The suction motor 310 may, for example, have an outer diameter in a range of 30 millimeters (mm) to 80 mm.

Figure 4:
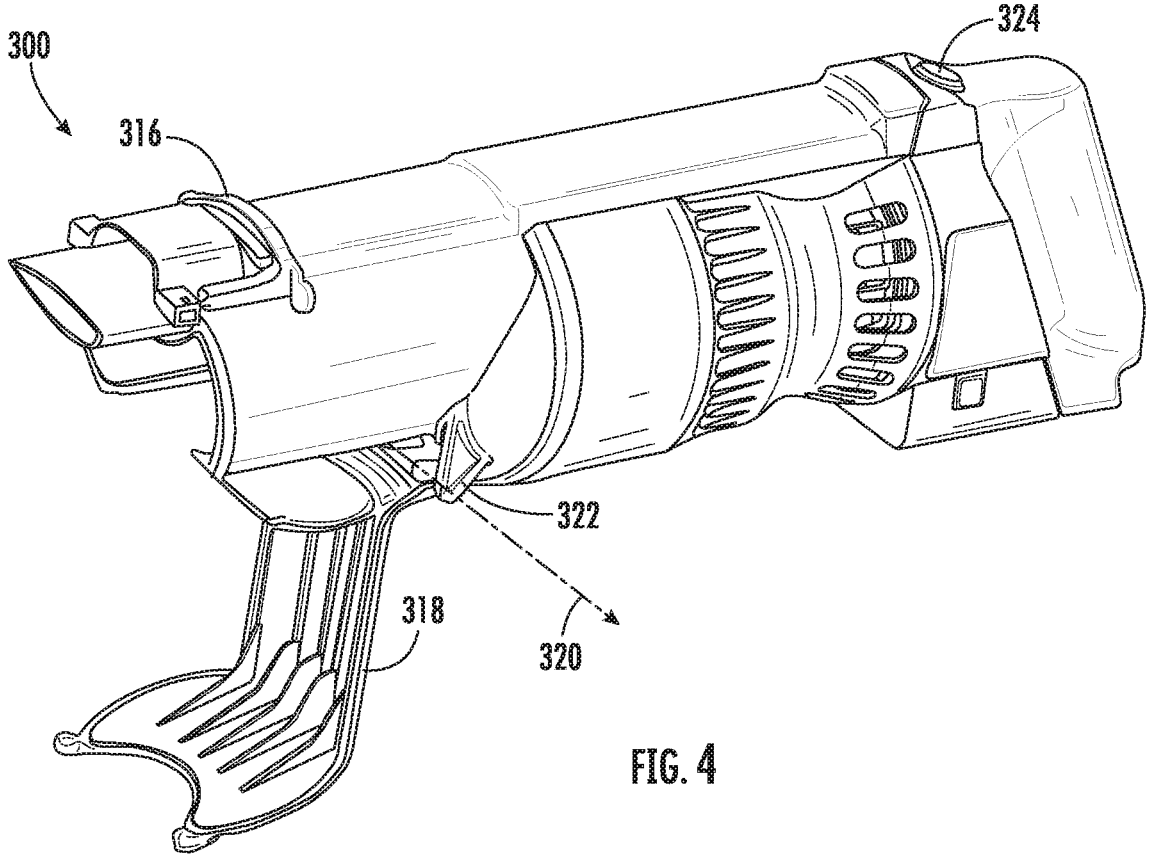
FIG. 4 is a perspective view of the vacuum cleaner of FIG. 3 having a dust cup door in an open position, consistent with embodiments of the present disclosure.

The dust cup 306 is configured to collect debris separated (e.g., by cyclonic action) from air flowing through the cyclonic separator 308. Debris collected within the dust cup 306 can be removed from the dust cup 306 in response to actuation of a dust cup release 316. Actuation of the dust cup release 316 may cause a dust cup door 318 to transition from a closed position (e.g., as shown in FIG. 3) towards an open position (e.g., as shown in FIG. 4). When in the open position, debris collected within the dust cup 306 can be emptied therefrom. As shown, when transitioning between the open and closed positions, the dust cup door 318 pivots about a pivot axis 320 defined by a hinge 322. In some instances, the hinge 322 may include a biasing mechanism (e.g., a spring) to urge the dust cup door 318 towards, for example, the open position.

Additionally, or alternatively, actuation of the dust cup release 316 may allow the entire dust cup 306 to be decoupled from the vacuum assembly 304. Once removed, an open end of the dust cup 306 may be exposed, allowing collected debris to be emptied therefrom.

In some instances, the cyclonic separator 308 and the dust cup 306 can be decoupled from the vacuum assembly 304. This may allow the cyclonic separator 308 and the dust cup 306 to be more easily cleaned. For example, this may allow the cyclonic separator 308 and dust cup 306 to be cleaned using water without potentially causing damage to the suction motor 310. The cyclonic separator 308 and dust cup 306 can be separated from the vacuum assembly 304 in response to actuation of an assembly release 324.

Figure 5:
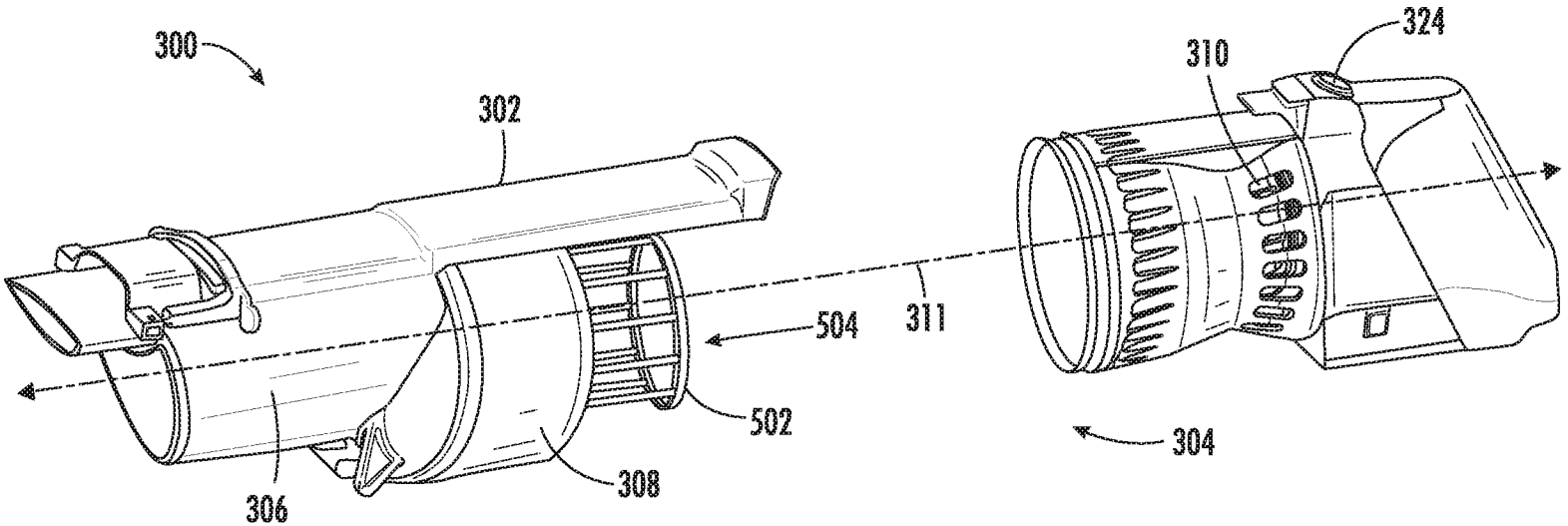
FIG. 5 is a perspective view of the vacuum cleaner of FIG. 3 having a cyclonic separator and dust cup decoupled from a vacuum assembly of the vacuum cleaner, consistent with embodiments of the present disclosure.

As shown, for example, in FIG. 5, when the assembly release 324 is actuated, the cyclonic separator 308 and dust cup 306 can be decoupled from the vacuum assembly 304 by moving the cyclonic separator 308 and dust cup 306 in a direction substantially parallel to, for example, the vacuum assembly longitudinal axis 311. As also shown, the wand 302 can be coupled to at least a portion of one or more of the dust cup 306 and/or the cyclonic separator 308. As such, the wand 302 is removed with the dust cup 306 and the cyclonic separator 308. Such a configuration may allow a user of the vacuum cleaner 300 to more easily clean the wand 302.

As also shown, a premotor filter holder 502 can extend from the cyclonic separator 308. The premotor filter holder 502 can be configured to receive a premotor filter. For example, the premotor filter holder 502 can define a receptacle 504 for receiving at least a portion of the suction motor 310. When the suction motor 310 is received within the receptacle 504, the premotor filter can extend around at least a portion of the suction motor 310 such that air drawn into the suction motor 310 passes through the premotor filter before passing through the suction motor 310.

Figure 6:
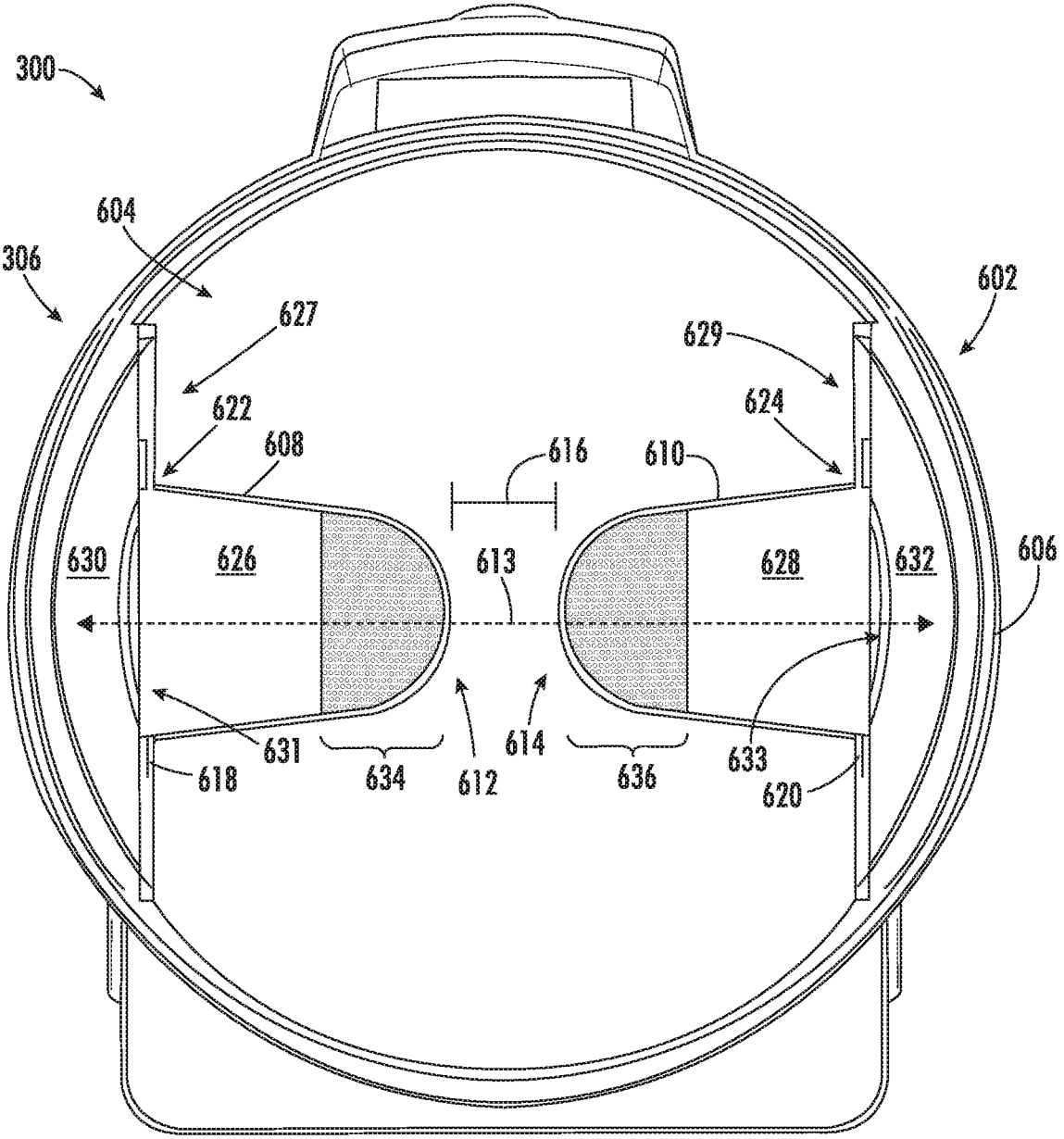
FIG. 6 is a cross-sectional side view taken along the line VI-VI of FIG. 3, consistent with embodiments of the present disclosure.

FIG. 6 shows a cross-sectional side view of the vacuum cleaner 300 of FIG. 3 taken along the line VI-VI of FIG. 3. As shown, the cyclonic separator 308 includes a housing 602 and a chamber 604. The housing 602 is configured to extend around the chamber 604, at least partially enclosing the chamber 604. In some instances, the chamber 604 may be at least partially defined by one or more sidewalls 606 of the housing 602.

As shown, the chamber 604 can include a first and a second vortex finder 608 and 610. The first and second vortex finders 608 and 610 are configured to encourage the development of cyclonic movement in air flowing around the first and second vortex finders 608 and 610. The cyclonic movement of air around the first and second vortex finders 608 and 610 encourages debris entrained within the air to fall out of the air.

The first and second vortex finders 608 and 610 can be disposed on opposing sides of the chamber 604 such that each of the vortex finders 608 and 610 extend into the chamber 604 towards each other. The first and second vortex finders 608 and 610 can extend along a common axis 613 extending through (e.g., centrally through) the chamber 604. In some instances, the first and second vortex finders 608 and 610 may be centrally aligned along the common axis 613. Distal ends 612 and 614 of the vortex finders 608 and 610 can be spaced apart from each other by a separation distance 616. The separation distance 616 may reduce and/or prevent the wrapping of fibrous debris (e.g., hair) around one or more of the vortex finders 608 and/or 610. As such, the chamber 604 may not include an arrestor plate extending between the first and second vortex finders 608 and 610. Omission of a physical arrestor plate may reduce the occurrence of obstructions within in the chamber 604 caused by debris getting stuck within the chamber 604 (e.g., between the arrestor plate and one or more vortex finders 608 and/or 610).

The first and second vortex finders 608 and 610 can include platforms 618 and 620 extending around proximal ends 622 and 624 of respective ones of the first and second vortex finders 608 and 610. The platforms 618 and 620 can be configured to define at least a portion of the chamber 604 when the vortex finders 608 and 610 are received within the chamber 604. In some instances, the platforms 618 and 620 can be configured to be removably coupled to a sidewall defining a portion of the chamber 604 such that the vortex finders 608 and 610 can be removed from the chamber 604 (e.g., for cleaning purposes).

The first and second vortex finders 608 and 610 are shown as being configured to operate in parallel and can each define a respective fluid pathway 626 and 628 through which air can flow. The fluid pathways 626 and 628 fluidly couple the chamber 604 to respective ducts 630 and 632 defined between the chamber 604 and the housing 602. As shown, the distal ends 612 and 614 include mesh regions 634 and 636 such that air within the chamber 604 can flow through the fluid pathways 626 and 628. The mesh regions 634 and 636 include a plurality of openings through which air can flow, defining an air permeable mesh. The size of the openings (or a mesh pore size) defining the mesh regions 634 and 636 can be such that debris particles having a particle size that exceeds a predetermined threshold size are generally prevented from passing therethrough. The proximal ends 622 and 624 can include outlets 631 and 633 that are fluidly coupled to respective ones of the ducts 630 and 632. The ducts 630 and 632 are fluidly coupled to the suction motor 310.

Figure 6A:
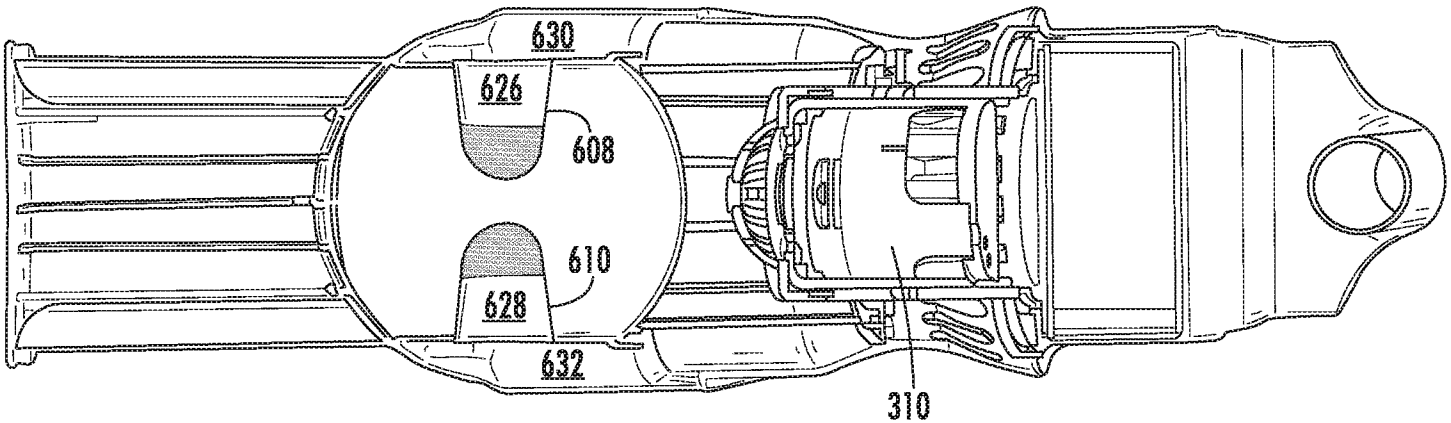
FIG. 6A is a cross-sectional side view taken along the line VI.A-VI.A of FIG. 3, consistent with embodiments of the present disclosure.

FIG. 6A shows a cross-sectional side view taken along the line VI.A-VI.A of FIG. 3. As shown, the first and second vortex finders 608 and 610 are fluidly coupled to the suction motor 310 via the ducts 630 and 632 in a parallel configuration. While a parallel configuration is shown, other configurations are possible. For example, the vortex finders 608 and 610 can be configured to operate in series (e.g., arranged such that air flows cyclonically around one of the vortex finders 608 or 610 before flowing cyclonically around the other of the vortex finders 608 or 610).

Figure 7:
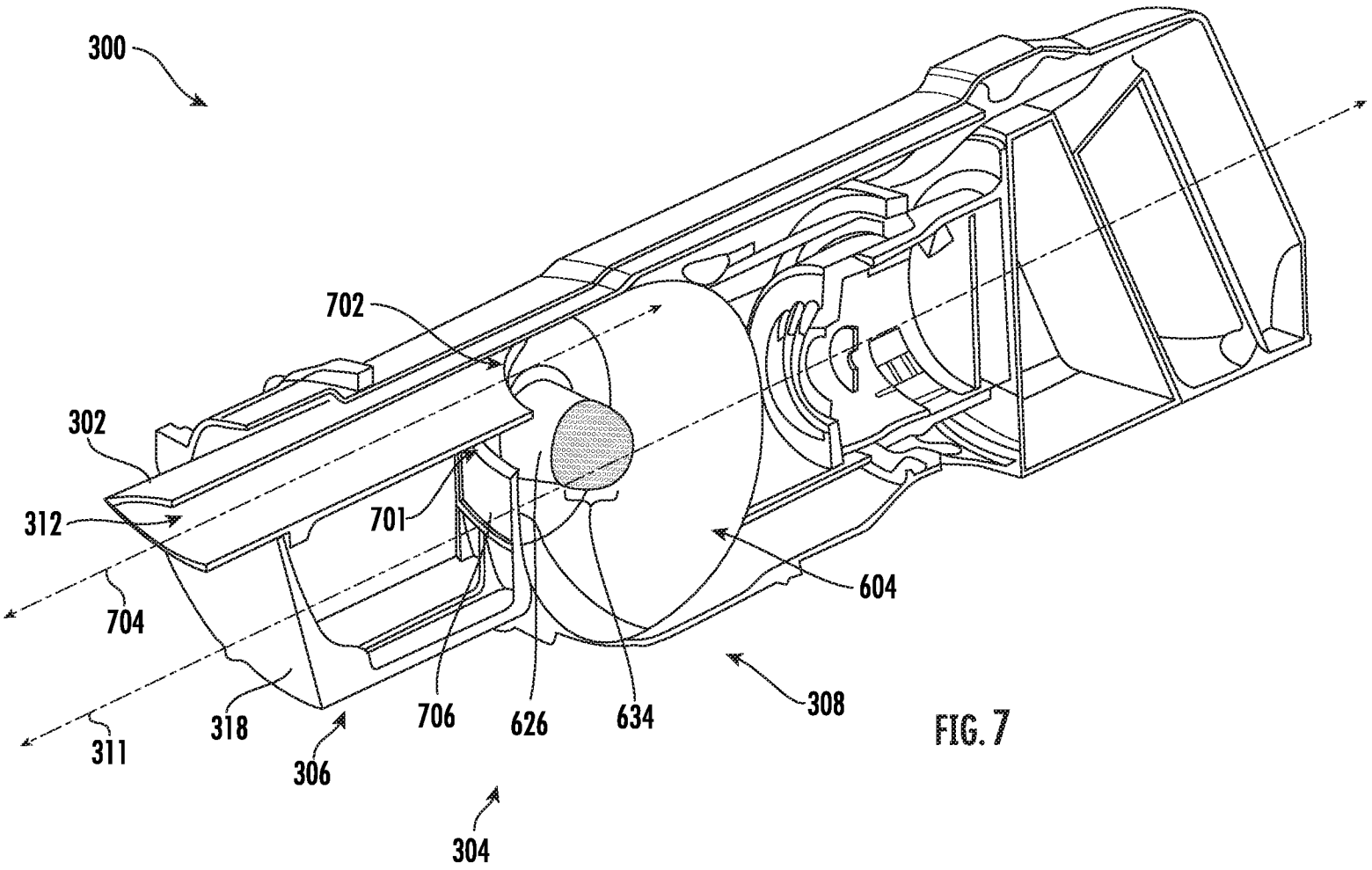
FIG. 7 is a cross-sectional perspective view taken along the line VII-VII of FIG. 3, consistent with embodiments of the present disclosure.

FIG. 7 shows a perspective cross-sectional view of the vacuum cleaner 300 of FIG. 3 taken along the line VII-VII of FIG. 3. As shown, the air channel 312 extending within the wand 302 is fluidly coupled to the chamber 604 of the cyclonic separator 308. The air channel outlet 702 is spaced apart from the vortex finders 608 and 610 such that a wand central axis 704 of the wand 302 does not intersect the central axes of the vortex finders 608 and 610. The wand central axis 704 can extend substantially parallel to the vacuum assembly longitudinal axis 311. Such a configuration may reduce and/or prevent clogging within the air channel 312 caused by debris getting trapped therein.

The air channel outlet 702 can be vertically spaced apart from the vortex finders 608 and 610. As such, air exiting the air channel outlet 702 is urged to change direction (e.g., urged downwardly) before passing through one or more of the mesh regions 634 and 636. In some instances, the wand central axis 704 can extend centrally between the vortex finders 608 and 610 while being vertically spaced apart from the vortex finders 608 and 610. As shown, the wand central axis 704 is vertically spaced apart from a centrally positioned vacuum assembly longitudinal axis 311 such that the wand 302 is positioned above the centrally positioned vacuum assembly longitudinal axis 311 (e.g., proximate a top surface of the vacuum cleaner 300). However, other configurations are possible, for example, the wand central axis 704 can be vertically spaced apart from the centrally positioned vacuum assembly longitudinal axis 311 such that the wand 302 is positioned below the centrally positioned vacuum assembly longitudinal axis 311 (e.g., proximate a bottom surface of the vacuum cleaner 300).

Figure 7A:
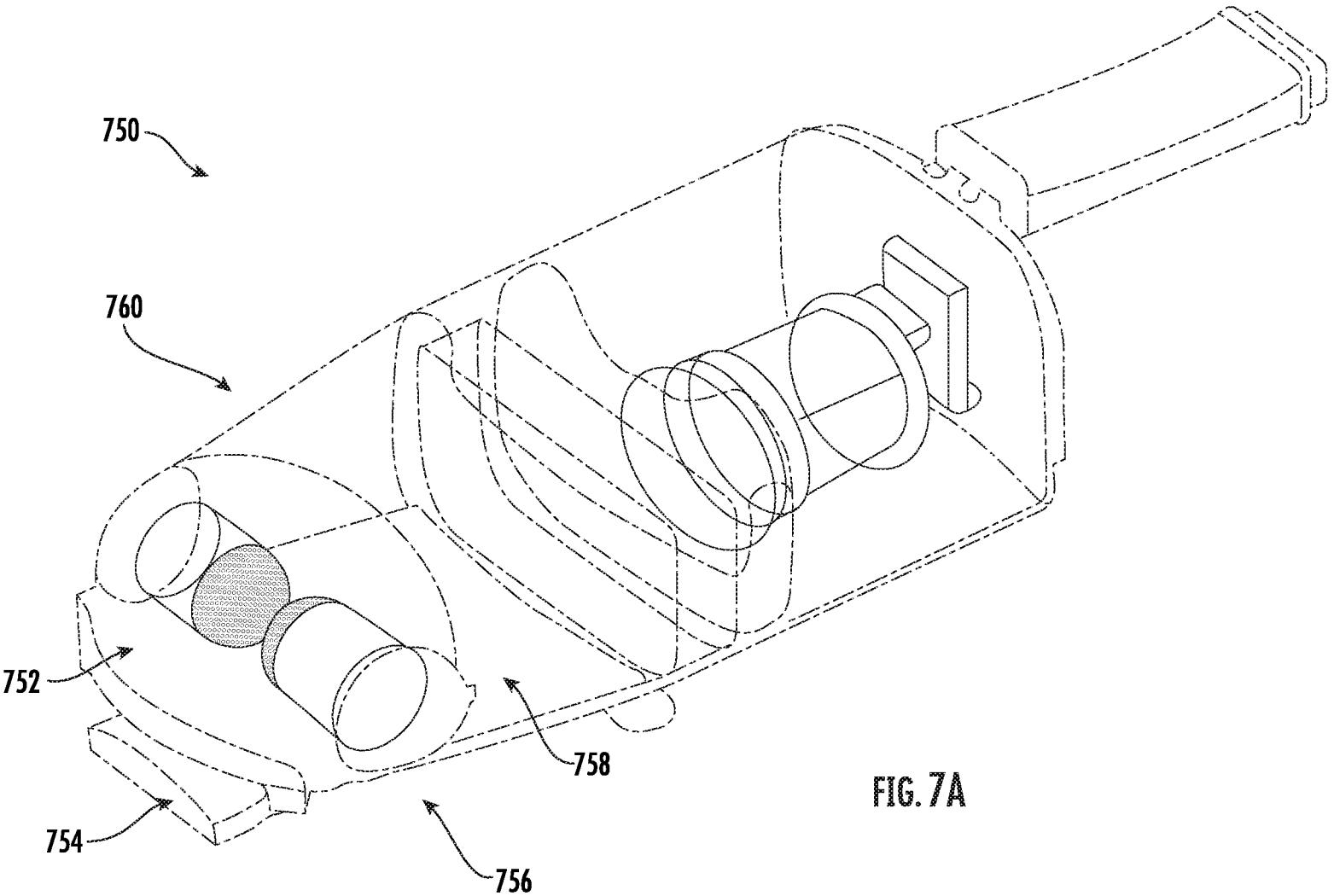
FIG. 7A is a perspective view of an example of a vacuum cleaner having a spheroid shaped chamber, consistent with embodiments of the present disclosure.
Figure 7B:
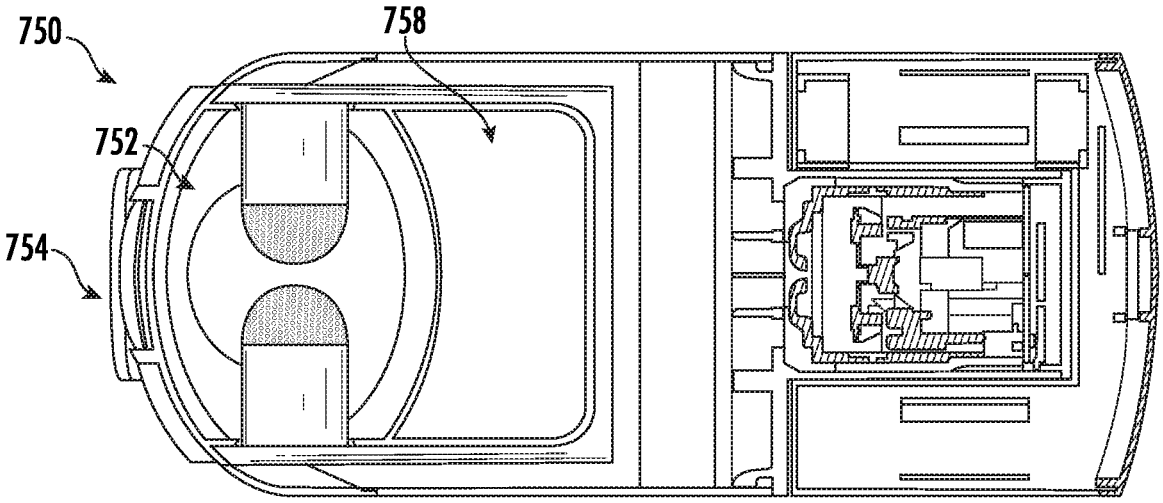
FIG. 7B is a cross-sectional side view of the vacuum cleaner of FIG. 7A, consistent with embodiments of the present disclosure.
Figure 7C:
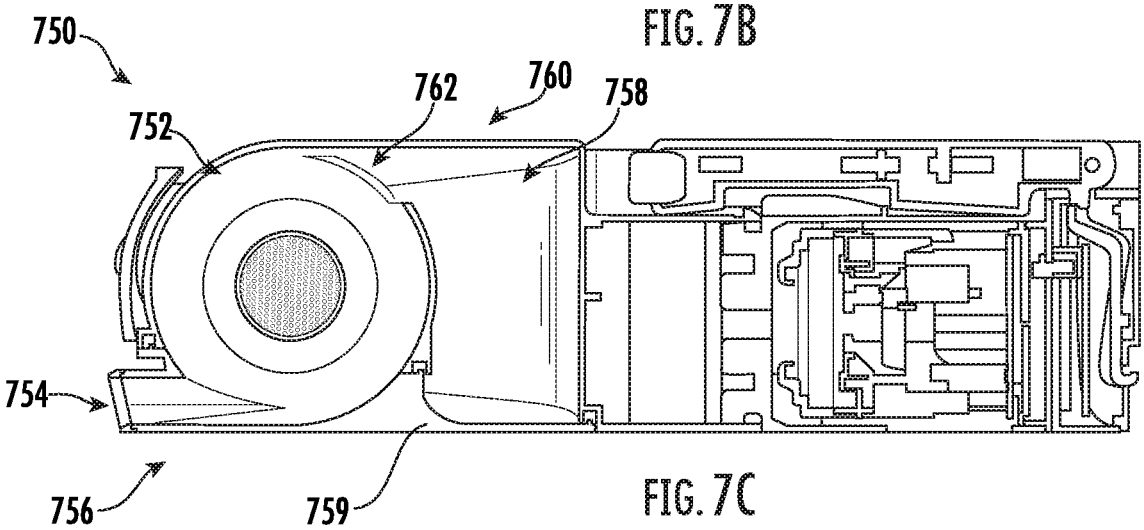
FIG. 7C is another cross-sectional side view of the vacuum cleaner of FIG. 7A, consistent with embodiments of the present disclosure.

As shown, the chamber 604 has an arcuate shape. The arcuate shape may define at least a portion of a sphere or cylinder. For example, the chamber 604 may have a shape of a truncated sphere having opposing planar surfaces 627 and 629 (see FIG. 6), wherein the vortex finders 608 and 610 extend from respective planar surfaces. The arcuate shape is configured to urge the air exiting the air channel outlet 702 towards the vortex finders 608 and 610. Such a configuration may encourage the formation of a cyclone that extends around respective vortex finders 608 and 610. In some instances, the chamber 604 may have a spheroid shape (e.g., an oblate spheroid shape or a prolate spheroid shape). A spheroid shaped chamber 604 may allow the vacuum cleaner 300 to have a thinner profile when compared to a spherical or cylindrical chamber 604. FIGS. 7A, 7B, and 7C show an example of a vacuum cleaner 750 having a chamber 752 with a prolate spheroid shape. As shown, an air inlet 754 to the prolate spheroid shaped chamber 752 may be disposed proximate a bottom surface 756 of the vacuum cleaner 750. Such a configuration may allow for debris within a dust cup 758 to be more easily emptied therefrom using a dust cup door 759 when compared to a configuration where the air inlet 754 is disposed proximate a top surface 760 of the vacuum cleaner 750. A storage capability may of the dust cup 758 may be based, at least in part, on a position of a debris outlet 762 relative to the top surface 760 of the vacuum cleaner 750 (e.g., as a separation distance between the debris outlet 762 and the top surface 760 decreases, the storage capability of the dust cup 758 may increase).

As also shown in FIG. 7, the dust cup door 318 includes a dust cup sidewall 706 that defines a portion of the chamber 604. The dust cup sidewall 706 is configured to define an opening (e.g., a debris outlet) 701 within the chamber 604 that fluidly couples the chamber 604 to the dust cup 306 such that debris cyclonically separated from air flowing within the chamber 604 can be deposited in the dust cup 306. A position of the opening 701 relative to a centrally positioned vacuum assembly longitudinal axis 311 may influence a debris storing capacity of the dust cup 306. For example, the opening 701 may be disposed at a location between the centrally positioned vacuum assembly longitudinal axis 311 and the wand central axis 704. When the dust cup door 318 transitions towards the open position, an opening in the chamber 604 to the environment is created. As such, any debris in the chamber 604 can also be emptied from the chamber 604 when the dust cup 306 is emptied.

Figure 8:
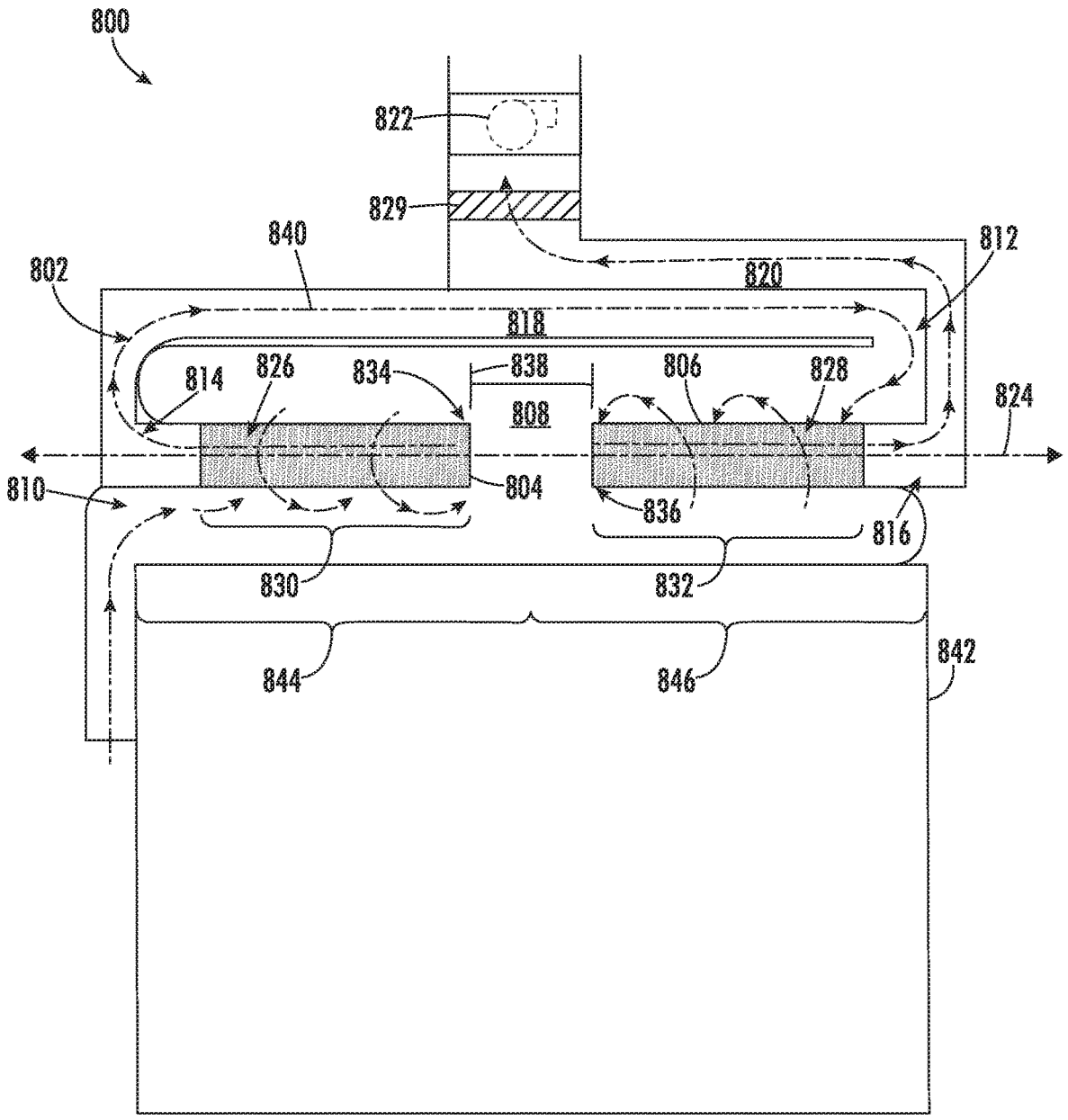
FIG. 8 is a schematic cross-sectional side view of a vacuum system having a cyclonic separator configured in series, consistent with embodiments of the present disclosure.

FIG. 8 shows a schematic example of a vacuum system 800 having a cyclonic separator 802. The cyclonic separator 802 includes a first vortex finder 804 and a second vortex finder 806 disposed within a chamber 808. The chamber 808 includes a first inlet 810, a second inlet 812, a first outlet 814, and a second outlet 816. A chamber duct 818 extends from the first outlet 814 to the second inlet 812 and an exit duct 820 extends from the second outlet 816 to a suction motor 822.

The first vortex finder 804 is fluidly coupled to the first outlet 814 and the second vortex finder 806 is fluidly coupled to the second outlet 816. As shown, the first vortex finder 804 extends from the first outlet 814 and into the chamber 808 and the second vortex finder 806 extends from the second outlet 816 and into the chamber 808. The first and second vortex finders 804 and 806 may extend into the chamber 808 towards each other. For example, the first and second vortex finders 804 and 806 may extend longitudinally along a common axis 824. The common axis 824 may correspond to a central longitudinal axis of the first and second vortex finders 804 and 806.

The first and second vortex finders 804 and 806 each define a fluid passageway 826 and 828 extending therein. The first fluid passageway 826 is fluidly coupled to the first outlet 814 and the second fluid passageway 828 is fluidly coupled to the second outlet 816. Each vortex finder 804 and 806 includes a corresponding mesh region 830 and 832. The mesh regions 830 and 832 are configured to fluidly couple a corresponding fluid passageway 826 or 828 to the chamber 808. The first mesh region 830 may be configured to have a different mesh pore size than the second mesh region 832. For example, the first mesh region 830 may be configured to allow larger debris, than the second mesh region 832, to pass therethrough. In other words, the mesh pore size of the first mesh region 830 may measure greater than that of the second mesh region 832. As such, first and second vortex finders 804 and 806 may generally be described as being configured to filter air passing therethrough.

Distal ends 834 and 836 of the first and second vortex finders 804 and 806 may be spaced apart by a separation distance 838. The separation distance 838 may reduce and/or prevent the wrapping of fibrous debris (e.g., hair) around one or more of the vortex finders 804 and/or 806 when air with entrained debris is drawn into the first inlet 810 of the chamber 808. As such, the chamber 808 may not include an arrestor plate extending between the first and second vortex finders 804 and 806.

In operation, the suction motor 822 is configured to cause air to be drawn into the vacuum system 800 along the airflow path 840. As shown, the airflow path 840 extends from the first inlet 810 and into the chamber 808. Once in the chamber 808, the airflow path 840 extends cyclonically around the first vortex finder 804 and passes through a portion of the first mesh region 830 and into the first fluid passageway 826 of the first vortex finder 804. The airflow path 840 then extends through the chamber duct 818, through the second inlet 812, and back into the chamber 808 such that the airflow path 840 extends cyclonically around the second vortex finder 806. The second mesh region 832 is configured such that the airflow path 840 can extend therethrough and into the second fluid passageway 828. As such, the first and second vortex finders 804 and 806 can generally be described as being arranged in series. From the second fluid passageway 828, the airflow path 840 extends through the second outlet 816, through the exit duct 820, and into the suction motor 822. In some instances, a premotor filter 829 may be positioned in the airflow path 840 between the second outlet 816 and the suction motor 822 (e.g., within the exit duct 820).

Air moving around the first and second vortex finders 804 and 806 is urged into a cyclonic motion about the vortex finders 804 and 806. The cyclonic motion of the air may cause debris entrained therein to fall out of entrainment and be deposited within a dust cup 842. In some instances, the first and second vortex finders 804 and 806 can be configured such that debris separated from air flowing thereabout has a different average size for each vortex finder 804 and 806. For example, debris separated from the air flowing about the first vortex finder 804 may have a larger average size than debris separated from air flowing about the second vortex finder 806. As such, the chamber 808 can generally be described as having a first debris filtering region 844 and a second debris filtering region 846, wherein the first debris filtering region 844 corresponds to the first vortex finder 804 and the second debris filtering region 846 corresponds to the second vortex finder 806.

Figure 9:
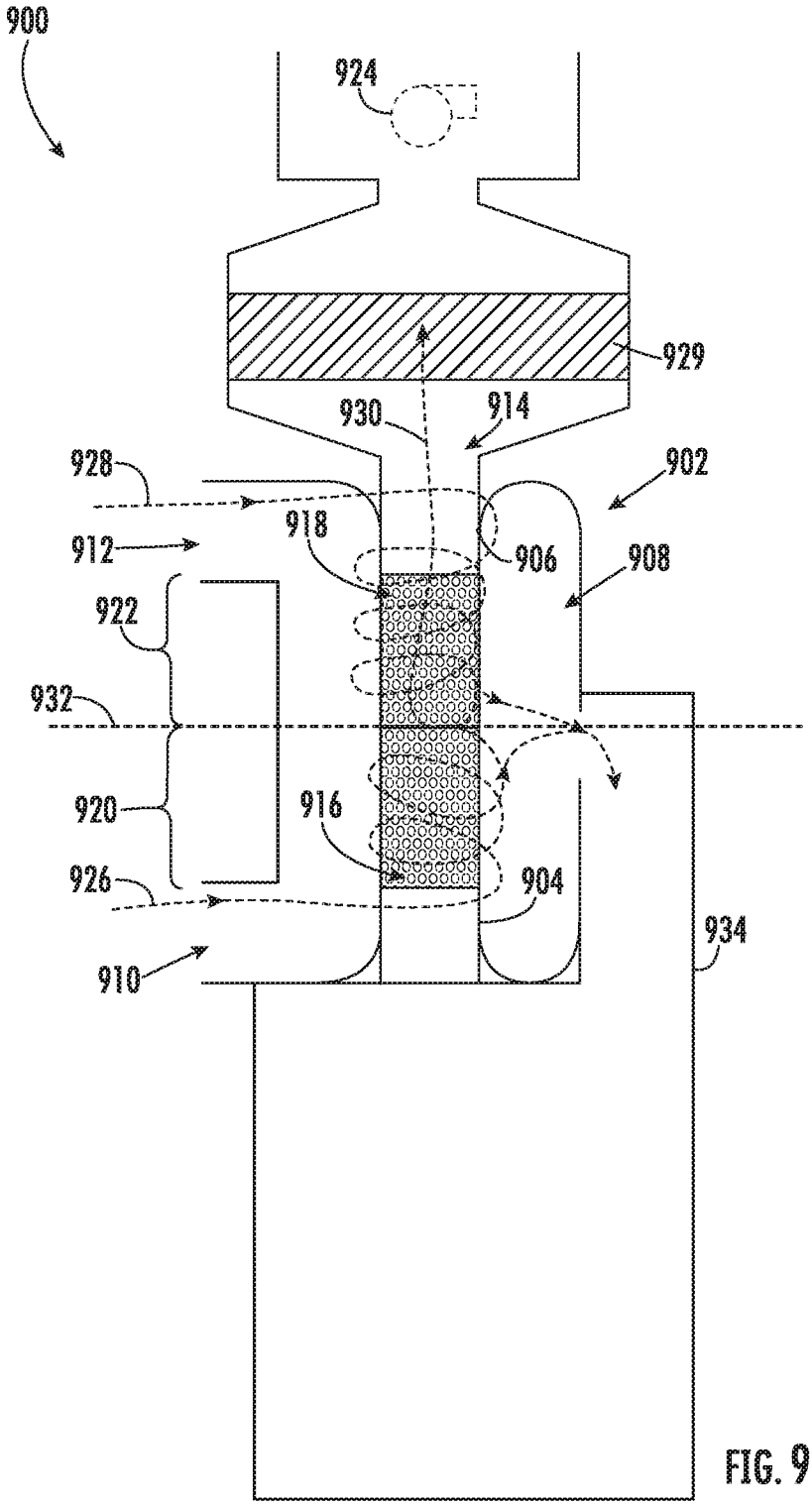
FIG. 9 is a schematic cross-sectional side view of a vacuum system having a cyclonic separator configured in parallel, consistent with embodiments of the present disclosure.

FIG. 9 shows a schematic example of a vacuum system 900 having a cyclonic separator 902. The cyclonic separator 902 includes a first vortex finder 904 and a second vortex finder 906 disposed within a chamber 908. The chamber 908 includes a first inlet 910, a second inlet 912, and an outlet 914.

The first and second vortex finders 904 and 906 each define a fluid passageway 916 and 918 extending therein. The first and second fluid passageways 916 and 918 are fluidly coupled to the outlet 914. In some instances, the first fluid passageway 916 may be fluidly coupled to the outlet 914 via the second fluid passageway 918. For example, one or more openings may be provided in the first and second vortex finders 904 and 906 such that the first and second fluid passageways 916 and 918 can be fluidly coupled together.

Each vortex finder 904 and 906 may include a corresponding mesh region 920 and 922. The mesh regions 920 and 922 are configured to fluidly couple the chamber 908 to a corresponding one of the first and second fluid passageways 916 and 918. Each mesh region 920 and 922 can be configured to have a mesh pore size that allows a desired size of debris to pass therethrough. In some instances, the mesh regions 920 and 922 may each have a different mesh pore size. Alternatively, the mesh regions 920 and 922 may have the same mesh pore size.

In operation a suction motor 924 is configured to cause air to be drawn into the vacuum system 900 along a first airflow path 926 or a second airflow path 928. The first airflow path 926 extends through the first inlet 910 into the chamber 908, cyclonically around the first vortex finder 904, and passes through a portion of the first mesh region 920. The second airflow path 928 extends through the second inlet 912 into the chamber 908, cyclonically around the second vortex finder 906, and passes through a portion of the second mesh region 922. As shown, the first airflow path 926 extends through the first fluid passageway 916 and converges with the second airflow path 928 in the second fluid passageway 918, forming a common airflow path 930. As such, the first and second vortex finders 904 and 906 can generally be described as being arranged in parallel. The common airflow path 930 extends from the second fluid passageway 918 through the outlet 914 and into the suction motor 924. In some instances, a premotor filter 929 may be disposed in the common airflow path 930 at a location between the suction motor 924 and the outlet 914.

Air flowing along the first airflow path 926 flows cyclonically around the first vortex finder 904 and moves longitudinally along the first vortex finder 904 in a direction of the second vortex finder 906. Air flowing along the second airflow path 928 flows cyclonically around the second vortex finder 906 and moves longitudinally along the second vortex finder 906 in a direction of the first vortex finder 904. Accordingly, air flowing cyclonically around the first and second vortex finders 904 and 906 according to the first and second airflow paths 926 and 928 can generally be described as converging towards an arrestor line 932. Due to the convergence of the first and second airflow paths 926 and 928 towards the arrestor line 932, the chamber 908 may not include an arrestor plate extending between the first and second vortex finders 904 and 906.

Air moving along the airflow path around the first and second vortex finders 904 and 906 is urged into a cyclonic motion about the vortex finders 904 and 906. The cyclonic motion of the air may cause debris entrained therein to fall out of entrainment and be deposited within a dust cup 934.

In some instances, the first and second vortex finders 904 and 906 are directly fluidly coupled to each other (e.g., formed as a single continuous body). In these instances, the first and second vortex finders 904 and 906 may be defined based on the location of the arrestor line 932 (e.g., the first and second vortex finders 904 and 906 are disposed on opposing sides of the arrestor line 932).

Figure 10:
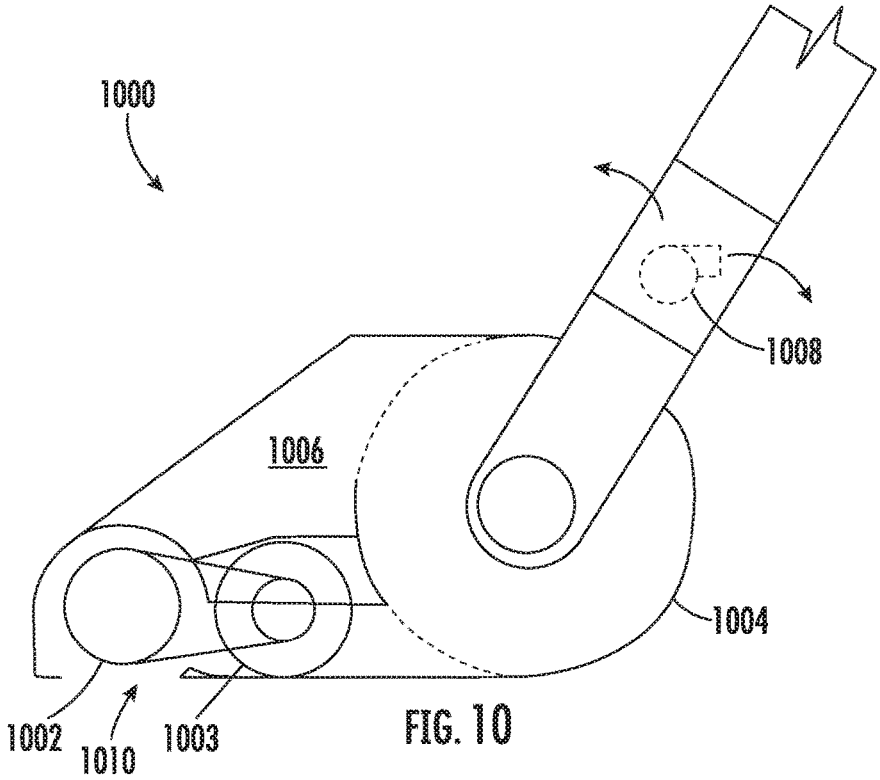
FIG. 10 is a schematic cross-sectional side view of a surface cleaning head having a cyclonic separator configured in parallel, consistent with embodiments of the present disclosure.
Figure 11:
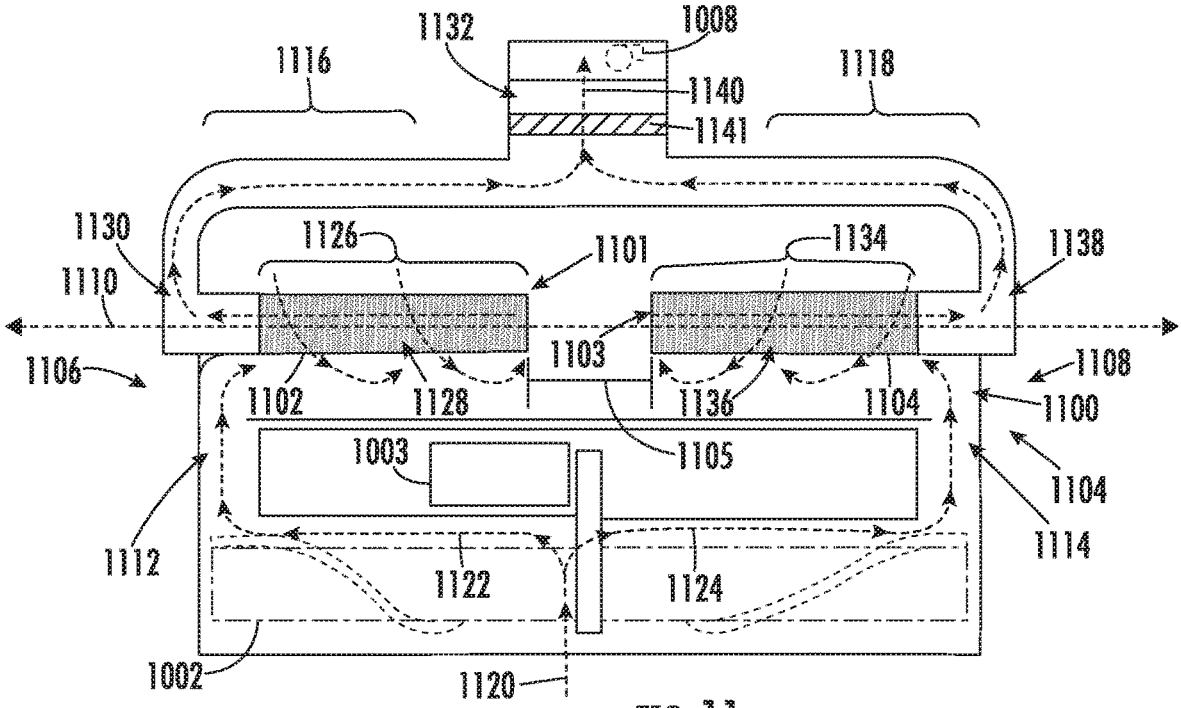
FIG. 11 is a schematic cross-sectional view of the surface cleaning head of FIG. 10, consistent with embodiments of the present disclosure.

FIG. 10 shows a schematic cross-sectional side view of a surface cleaning head 1000 taken in a first plane and FIG. 11 shows a schematic cross-sectional side view of the surface cleaning head 1000 taken in a second plane.

As shown in FIG. 10, the surface cleaning head 1000 includes an agitator 1002 (e.g., a brush roll), an agitator drive motor 1003 configured to rotate the agitator 1002 about an axis that extends generally parallel to a surface to be cleaned (e.g., a floor), a cyclonic separator 1004, a dust cup 1006, and a suction motor 1008 configured to draw air through an air inlet 1010 of the surface cleaning head 1000. The suction motor 1008 is fluidly coupled to the air inlet 1010 via the cyclonic separator 1004.

As shown, the agitator 1002 is positioned within the air inlet 1010 such that air flows over at least a portion of the agitator when the suction motor 1008 is activated. As such, in operation, at least a portion of debris agitated from the surface to be cleaned by the agitator 1002 becomes entrained within air flowing through the air inlet 1010. As air from the air inlet 1010 flows through cyclonic separator 1004, the cyclonic separator is configured to urge the air into a cyclonic motion such that at least a portion of debris entrained therein is separated from the airflow due to the cyclonic motion of the air. The debris separated from the air is deposited in the dust cup 1006.

As shown in FIG. 11, the cyclonic separator 1004 includes a chamber 1100 having a first and second vortex finder 1102 and 1104 extending therein. The first and second vortex finders 1102 and 1104 extend longitudinally from opposing distal ends 1106 and 1108 of the chamber 1100. As shown, the first and second vortex finders 1102 and 1104 extend along a common axis 1110 that generally corresponds to a central longitudinal axis of each of the vortex finders 1102 and 1104. Distal ends 1101 and 1103 of the first and second vortex finders 1102 and 1104 may be spaced apart by a separation distance 1105. The separation distance 1105 may reduce and/or prevent the wrapping of fibrous debris (e.g., hair) around one or more of the vortex finders 1102 and/or 1104. As such, the chamber 1100 may not include an arrestor plate extending between the first and second vortex finders 1102 and 1104.

The chamber 1100 includes a first and second chamber inlet 1112 and 1114 defined in opposing end regions 1116 and 1118 of the chamber 1100. The first end region 1116 may extend longitudinally from the first distal end 1106 for a first end region distance and the second end region 1118 may extend longitudinally from the second distal end 1108 for a second end region distance. The first and second end region distance may measure less than 45%, 40%, 35%, 30%, 25%, 20%, 15%, 10%, or 5% of a total longitudinal length of the chamber 1100.

The first and second chamber inlets 1112 and 1114 are each fluidly coupled to the air inlet 1010. As shown, the first and second chamber inlets 1112 and 1114 each have an opening area that measures less than an opening area of the air inlet 1010. For example, a sum of the opening areas for each of the first and second chamber inlets 1112 and 1114 may measure less than an opening area of the air inlet 1010. Such a configuration may increase a flow velocity of air flowing through the surface cleaning head 1000 at locations adjacent the sides of the surface cleaning head 1000. This may improve debris entrainment in the airflow at locations adjacent the sides of the surface cleaning head 1000 and may improve the overall cleaning performance of the surface cleaning head 1000.

In operation, the suction motor 1008 causes air to enter the air inlet 1010 along an entry airflow path 1120. The entry airflow path 1120 extends over a portion of the agitator 1002 and diverges into a first chamber airflow path 1122 and a second chamber airflow path 1124. The first chamber airflow path 1122 extends through the first chamber inlet 1112 and into the chamber 1100. Once in the chamber 1100, the first chamber airflow path 1122 extends cyclonically around the first vortex finder 1102, passes through a portion of a first meshed region 1126 of the first vortex finder 1102, and enters a first fluid passageway 1128 defined in the first vortex finder 1102. From the first fluid passageway 1128, the first chamber airflow path 1122 extends through a first chamber duct 1130 and into a common plenum 1132. The second chamber airflow path 1124 extends through second chamber inlet 1114 and into the chamber 1100. Once in the chamber 1100, the second chamber airflow path 1124 extends cyclonically around the second vortex finder 1104, passes through a portion of a second meshed region 1134 of the second vortex finder 1104, and enters a second fluid passageway 1136 defined in the second vortex finder 1104. From the second fluid passageway 1136, the second chamber airflow path 1124 extends through a second chamber duct 1138 and into the common plenum 1132. Once in the common plenum 1132, the first and second chamber airflow paths 1122 and 1124 converge into an exit airflow path 1140 that extends through the suction motor 1008. In some instances, the exit airflow path 1140 may extend through a premotor filter 1141 before passing through the suction motor 1008. As such, the first and second vortex finders 1102 and 1104 can generally be described as being arranged in parallel.

Figure 12:
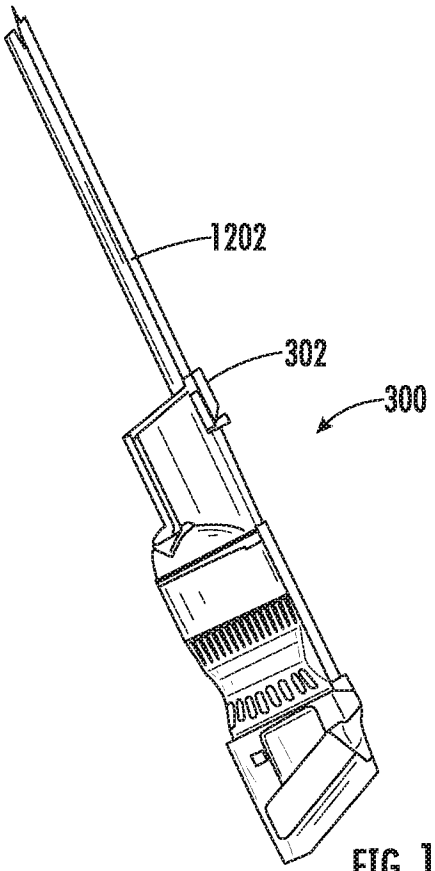
FIG. 12 is a perspective view of the vacuum cleaner of FIG. 3 coupled to a wand extension accessory, consistent with embodiments of the present disclosure.

FIG. 12 shows an example of the vacuum cleaner 300 coupled to a wand extension accessory 1202. The wand extension accessory 1202 is configured to couple to the wand 302.

Figure 13:
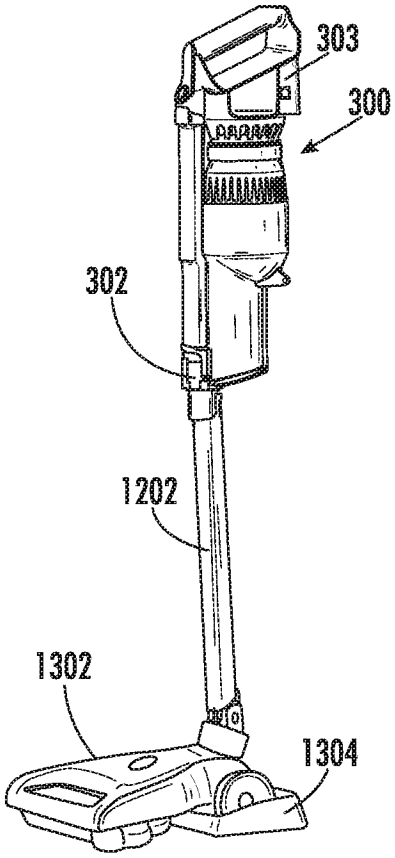
FIG. 13 is a perspective view of the vacuum cleaner of FIG. 3 coupled to a surface cleaning head accessory, consistent with embodiments of the present disclosure.

FIG. 13 shows an example of the vacuum cleaner 300 coupled to a surface cleaning head accessory 1302. The surface cleaning head accessory 1302 includes one or more brush rolls 1303 (see FIG. 10) configured to engage a surface to be cleaned (e.g., a floor). The surface cleaning head accessory 1302 is configured to couple to the wand 302 or the wand extension accessory 1202. As shown, the vacuum cleaner 300 can be configured to engage a docking station 1304 when coupled to the surface cleaning head accessory 1302. The docking station 1304 can be configured to recharge one or more batteries of the power source 303.

Figure 14:
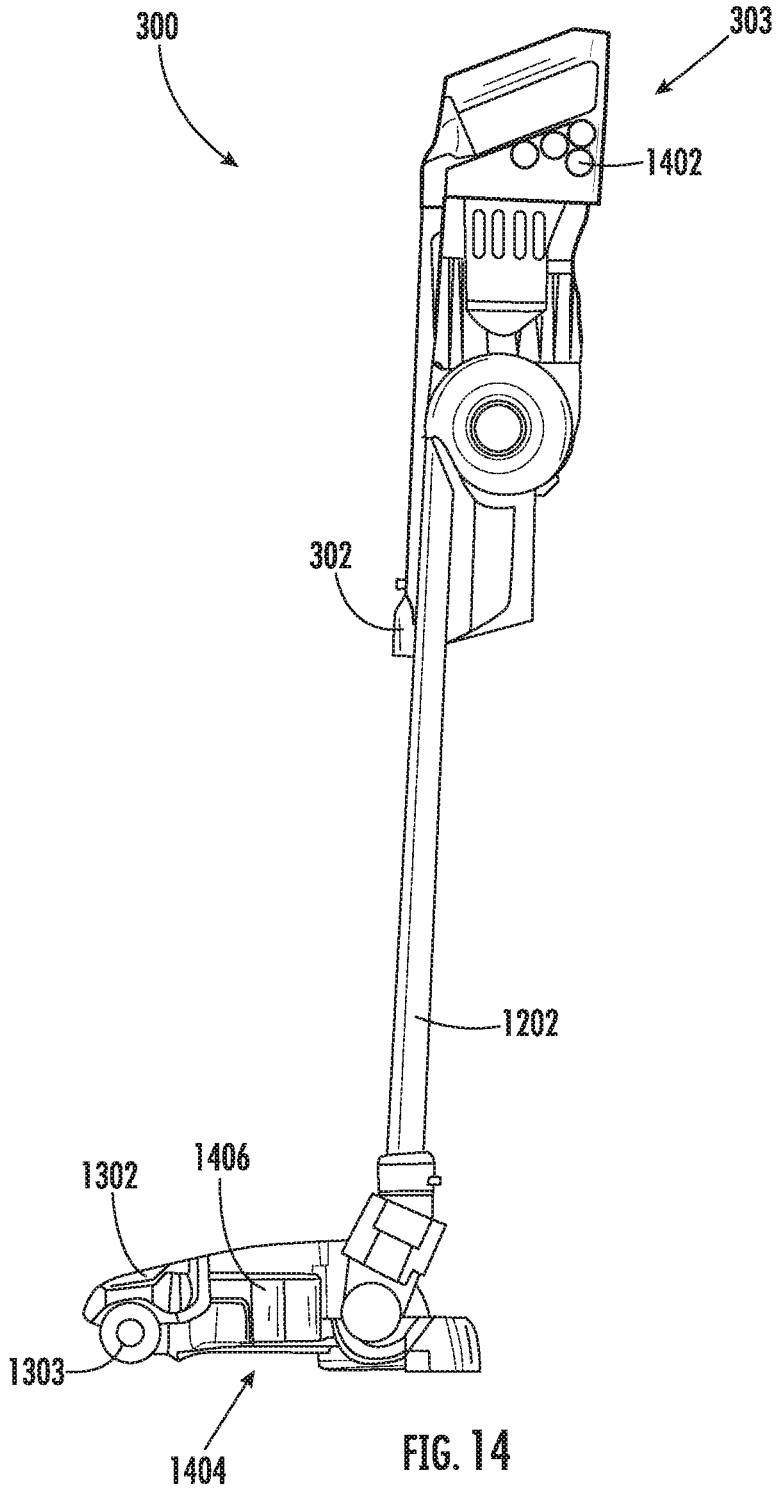
FIG. 14 is a cross-sectional side view of the vacuum cleaner of FIG. 13, consistent with embodiments of the present disclosure.

FIG. 14 shows a cross-sectional view of the vacuum cleaner 300 coupled to the surface cleaning head accessory 1302 of FIG. 13. As shown, the power source 303 can include, for example, one or more batteries 1402. The one or more batteries 1402 may include lithium ion batteries. As also shown, the surface cleaning head accessory 1302 can include an additional power source 1404. The additional power source 1404 can include one or more batteries 1406 configured to provide power to, for example, one or more motors configured to cause the brush rolls 1303 to rotate. The one or more batteries 1406 may include, for example, one or more nickel-metal hydride batteries. In some instances, the power source 303 can provide power to the surface cleaning head accessory 1302. For example, the wand 302 and/or the wand extension accessory 1202 can be configured to carry power (e.g., using one or more wires extending therein).

Figure 15:
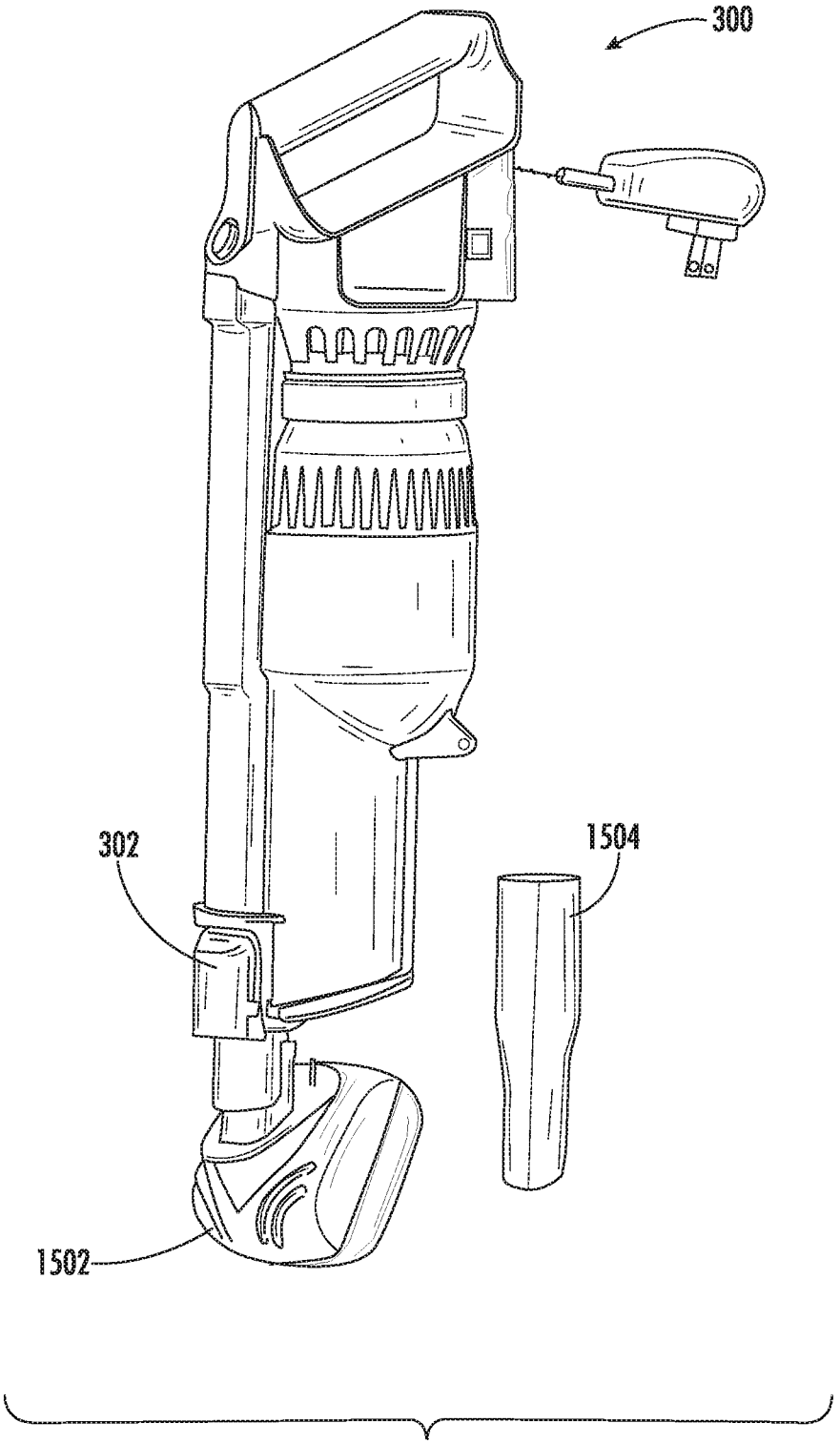
FIG. 15 is a perspective view of the vacuum cleaner of FIG. 3 coupled to a surface cleaning accessory and a perspective view of a crevice tool accessory configured to couple to the vacuum cleaner, consistent with embodiments of the present disclosure.

FIG. 15 shows the vacuum cleaner 300 coupled to a surface cleaning accessory 1502. In some instances, the vacuum cleaner 300 can be coupled to a crevice tool accessory 1504. The surface cleaning accessory 1502 and the crevice tool accessory 1504 can be configured to couple to the wand 302.

FIG. 16 is a table showing an example of air power, air flow, and suction for various orifice (e.g., inlet) diameters of an example of the vacuum cleaner 300 having 300 W of power and a brushless DC motor. FIG. 17 is a table showing the efficiency of an example of the cyclonic separator 308.

Figure 18:
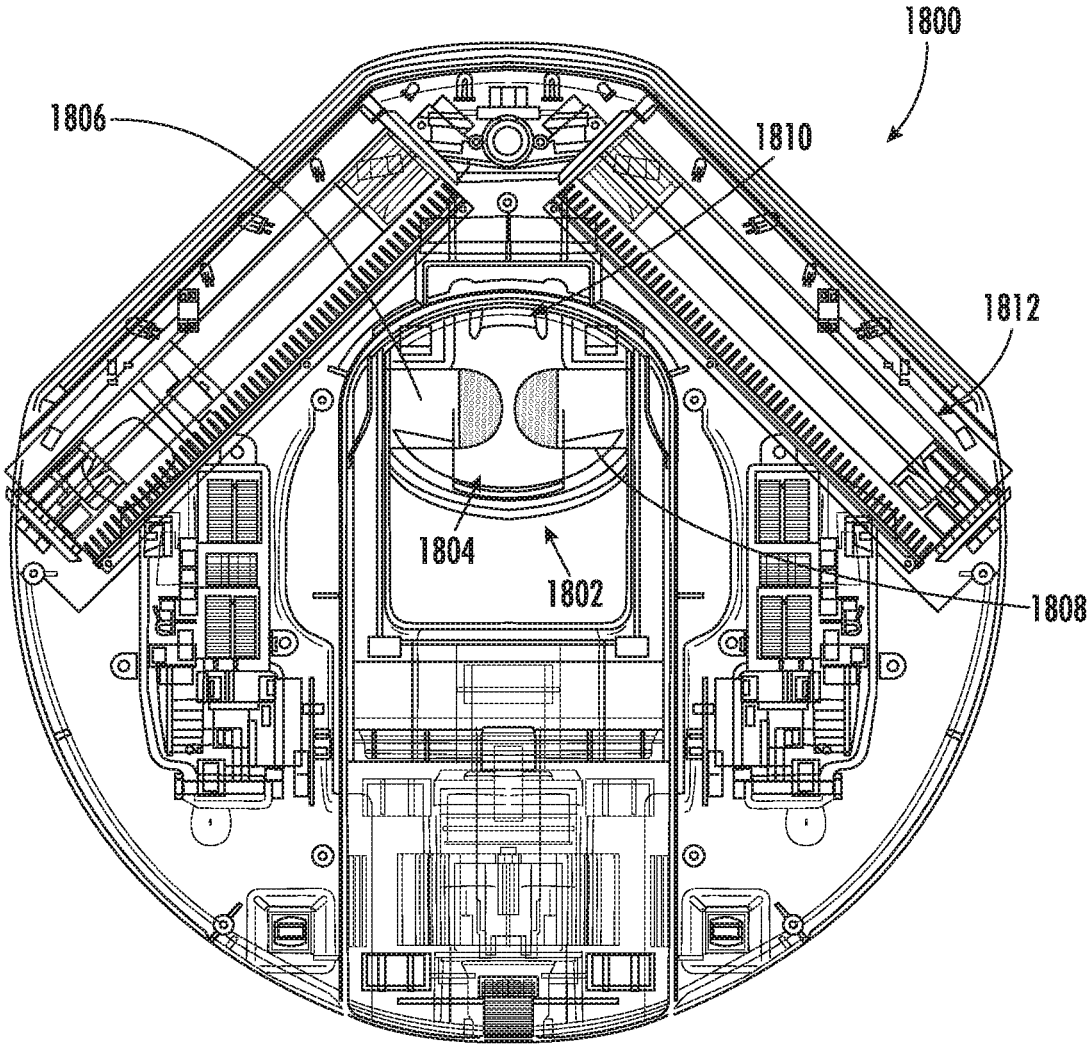
FIG. 18 is side view of an example of a robotic vacuum cleaner, consistent with embodiments of the present disclosure.

FIG. 18 shows an example of a robotic vacuum cleaner 1800 having a cyclonic separator 1802. The cyclonic separator 1802 includes a chamber 1804 having a plurality of vortex finders 1806 and 1808 extending into the chamber 1804 from opposing ends of the chamber 1804. The vortex finders 1806 and 1808 are arranged in a parallel configuration. However, the vortex finders 1806 and 1808 may be arranged in series.

As shown, the chamber 1804 has a prolate spheroid shape. A prolate spheroid shape may reduce a height of the robotic vacuum cleaner 1800 when compared to when the chamber 1804 has a spherical shape. A chamber inlet 1810 of the chamber 1804 is fluidly coupled to one or more air inlets 1812 of the robotic vacuum cleaner 1800. As such, the chamber inlet 1810 may be disposed between the vortex finders 1806 and 1808 and a bottom surface of the robotic vacuum cleaner 1800 (e.g., a surface of the robotic vacuum cleaner 1800 closest to a surface to be cleaned). In some instances, the chamber inlet 1810 may be at least partially defined by the bottom surface of the robotic cleaner 1800.

Figure 19:
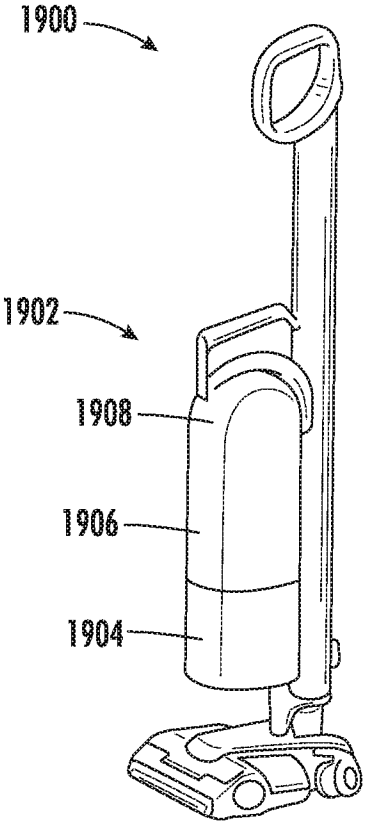
FIG. 19 is a perspective view of an upright vacuum cleaner, consistent with embodiments of the present disclosure.

FIG. 19 shows a perspective view of an upright vacuum cleaner 1900 having a vacuum assembly 1902. The vacuum assembly 1902 includes a suction motor 1904, a dust cup 1906, and a cyclonic separator 1908.

Figure 21:
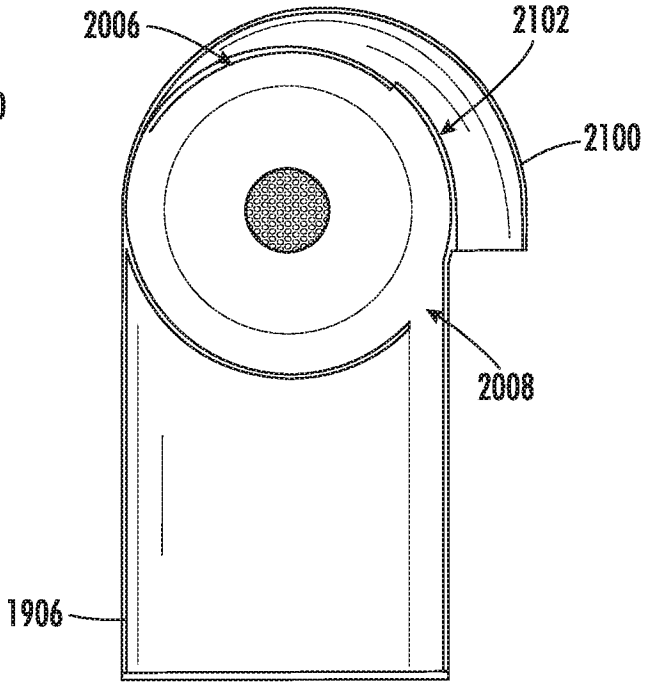
FIG. 21 is a cross-sectional side view of the cyclonic separator and dust cup of FIG. 20, consistent with embodiments of the present disclosure.
Figure 20:
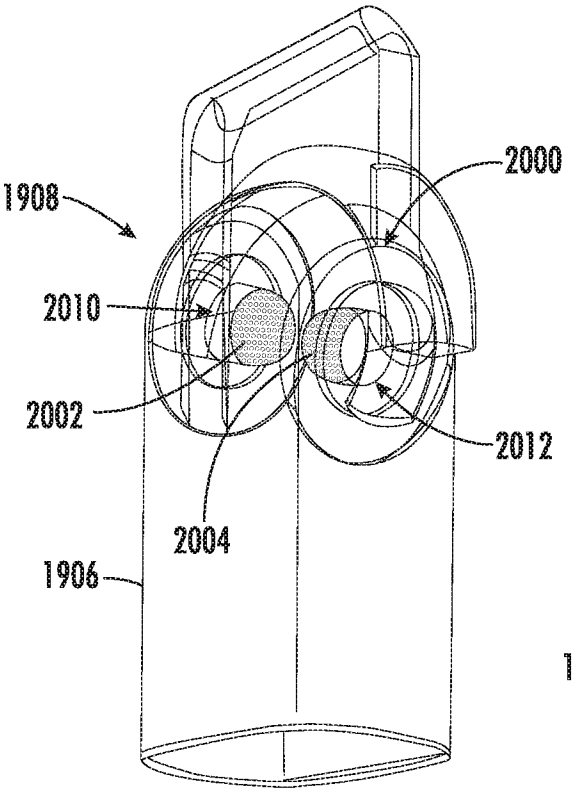
FIG. 20 is a perspective view of a cyclonic separator and a dust cup of the vacuum cleaner of FIG. 19, consistent with embodiments of the present disclosure.

FIG. 20 shows a perspective transparent view of the cyclonic separator 1908 and the dust cup 1906 and FIG. 21 shows a cross-sectional view of the cyclonic separator 1908 and the dust cup 1906. As shown, the cyclonic separator 1908 includes a chamber 2000 having a first and second vortex finder 2002 and 2004 extending from opposing sides of the chamber 2000. The chamber 2000 includes an air inlet 2006, a debris outlet 2008, a first outlet 2010, and a second outlet 2012. The first and second outlets 2010 and 2012 fluidly couple the vortex finders 2002 and 2004 to the suction motor 1904. The debris outlet 2008 is configured such that debris cyclonically separated from air flowing through the chamber 2000 can be deposited in the dust cup 1906. As shown, an inlet duct 2100 may extend from the air inlet 2006 and along an outer surface 2102 of the chamber 2000. As such, the inlet duct 2100 may generally be described as having an arcuate shape. The arcuate shape of the inlet duct 2100 may improve separation efficiency of the cyclonic separator 1908 (e.g., a quantity of debris cyclonically separated from an airflow may be improved). The shape and position of the inlet duct 2100 may also be configured to facilitate the fluid coupling of the cyclonic separator 1908 to another vacuum cleaner component (e.g., one or more of a hose, surface cleaning head, and/or any other vacuum cleaner component).

An example of a vacuum cleaner consistent with the present disclosure may include a suction motor and a cyclonic separator fluidly coupled to the suction motor. The cyclonic separator may include a chamber and a first and a second vortex finder extending within the chamber. The first and second vortex finders may extend from opposing sides of the chamber.

In some instances, distal ends of the first and second vortex finders may be spaced apart from each other by a separation distance. In some instances, the first and second vortex finders may be arranged in parallel. In some instances, the first and second vortex finders may be arranged in series. In some instances, the cyclonic separator may further include a housing extending around at least a portion of the chamber. In some instances, one or more ducts may be defined between the chamber and the housing. In some instances, the one or more ducts may be fluidly coupled to one or more of the first and second vortex finders and the suction motor such that air drawn through the first and second vortex finders by the suction motor passes through the one or more ducts and into the suction motor. In some instances, the chamber may have an arcuate shape. In some instances, the chamber may have a shape that corresponds to a truncated sphere having opposing planar surfaces, wherein the first and second vortex finders extend from the planar surfaces. In some instances, the vacuum cleaner may further include a dust cup, wherein the dust cup is configured to collect debris cyclonically separated from air flowing through the cyclonic separator. In some instances, the dust cup may include a dust cup door. In some instances, the dust cup door may be configured to transition from a closed position towards an open position in response to actuation of a dust cup release.

An example of a cyclonic separator for a vacuum cleaner consistent with the present disclosure may include a chamber configured to be fluidly coupled to a suction motor and a first and a second vortex finder extending within the chamber. The first and second vortex finders may extend from opposing sides of the chamber.

In some instances, distal ends of the first and second vortex finders may be spaced apart from each other by a separation distance. In some instances, the first and second vortex finders may be arranged in parallel. In some instances, the first and second vortex finders may be arranged in series. In some instances, the cyclonic separator may further include a housing extending around at least a portion of the chamber. In some instances, one or more ducts may be defined between the chamber and the housing. In some instances, the one or more ducts may be fluidly coupled to one or more of the first and second vortex finders and may be configured to be fluidly coupled to the suction motor such that air drawn through the first and second vortex finders by the suction motor passes through the one or more ducts and into the suction motor. In some instances, the chamber may have a shape that corresponds to a truncated sphere having opposing planar surfaces, wherein the first and second vortex finders extend from the planar surfaces.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner comprising:

a suction motor;

a cyclonic separator fluidly coupled to the suction motor, the cyclonic separator comprising:

a chamber having a generally truncated spherical shape having opposing planar surfaces; and a first and a second vortex finder extending from the opposing planar surfaces and partially across the chamber generally towards each other such that distal ends of the first and second vortex finders are spaced apart from each other by a separation distance;

wherein the first and second vortex finders are separately fluidly coupled to the chamber and the suction motor is configured to draw air from the chamber through the first and second vortex finders; and a dust cup configured to collect debris separated from air flowing through the cyclonic separator, the dust cup including a dust cup sidewall that defines a portion of the chamber and further defines at least a portion of a debris outlet that fluidly couples the chamber to the dust cup.

2. The vacuum cleaner of claim 1, wherein the first and second vortex finders are arranged in parallel.

3. The vacuum cleaner of claim 1, wherein the first and second vortex finders are arranged in series.

4. The vacuum cleaner of claim 1, wherein the cyclonic separator further comprises a housing extending around at least a portion of the chamber.

5. The vacuum cleaner of claim 4, wherein one or more ducts are defined between the chamber and the housing.

6. The vacuum cleaner of claim 5, wherein the one or more ducts are fluidly coupled to one or more of the first and second vortex finders and the suction motor such that air drawn through the first and second vortex finders by the suction motor passes through the one or more ducts and into the suction motor.

7. The vacuum cleaner of claim 1, wherein the dust cup further comprises a dust cup door, the dust cup sidewall extending from the dust cup door.

8. The vacuum cleaner of claim 7, wherein the dust cup door is configured to transition from a closed position towards an open position in response to actuation of a dust cup release.

9. A cyclonic separator for a vacuum cleaner comprising:

a chamber having a generally truncated spherical shape having opposing planar surfaces and configured to be fluidly coupled to a suction motor, wherein a portion of the chamber is defined by a dust cup sidewall of a dust cup and the chamber further includes a debris outlet that is at least partially defined by the dust cup sidewall; and a first and a second vortex finder extending from the opposing planar surfaces and partially across the chamber generally towards each other such that distal ends of the first and second vortex finders are spaced apart from each other by a separation distance;

wherein the first and second vortex finders are separately fluidly coupled to the chamber and a suction motor is configured to draw air from the chamber through the first and second vortex finders.

10. The cyclonic separator of claim 9, wherein the first and second vortex finders are arranged in parallel.

11. The cyclonic separator of claim 9, wherein the first and second vortex finders are arranged in series.

12. The cyclonic separator of claim 9, wherein the cyclonic separator further comprises a housing extending around at least a portion of the chamber.

13. The cyclonic separator of claim 12, wherein one or more ducts are defined between the chamber and the housing.

14. The cyclonic separator of claim 13, wherein the one or more ducts are fluidly coupled to one or more of the first and second vortex finders and are configured to be fluidly coupled to the suction motor such that air drawn through the first and second vortex finders by the suction motor passes through the one or more ducts and into the suction motor.

15. The vacuum cleaner of claim 1, wherein the first and the second vortex finders are configured to be removed from the opposing planar surfaces of the chamber.

16. The vacuum cleaner of claim 15, wherein the first and the second vortex finders include a first and a second platform configured to be removably coupled to the opposing planar surfaces of the chamber, respectively, the first and second platforms defining at least a portion of the opposing planar surfaces of the chamber.

17. The cyclonic separator of claim 9, wherein the first and the second vortex finders are configured to be removed from the opposing planar surfaces of the chamber.

18. The cyclonic separator of claim 17, wherein the first and the second vortex finders include a first and a second platform configured to be removably coupled to the opposing planar surfaces of the chamber, respectively, the first and second platforms defining at least a portion of the opposing planar surfaces of the chamber.

19. The cyclonic separator of claim 1, wherein the distal ends of the first and the second vortex finders have a generally truncated spherical shape.

* * * * *